US009432785B2

(12) United States Patent
Kappus et al.

(10) Patent No.: US 9,432,785 B2
(45) Date of Patent: Aug. 30, 2016

(54) ERROR CORRECTION FOR ULTRASONIC AUDIO SYSTEMS

(71) Applicant: Turtle Beach Corporation, Poway, CA (US)

(72) Inventors: Brian Alan Kappus, Poway, CA (US); Elwood Grant Norris, Poway, CA (US)

(73) Assignee: Turtle Beach Corporation, San Diego, CA (US)

( * ) Notice: Subject to any disclaimer, the term of this patent is extended or adjusted under 35 U.S.C. 154(b) by 116 days.

(21) Appl. No.: 14/566,592

(22) Filed: Dec. 10, 2014

(65) Prior Publication Data

US 2016/0174003 A1 Jun. 16, 2016

(51) Int. Cl.
*H04R 29/00* (2006.01)

(52) U.S. Cl.
CPC ..... *H04R 29/00* (2013.01)

(58) Field of Classification Search
None
See application file for complete search history.

(56) References Cited

U.S. PATENT DOCUMENTS 6,584,205 B1 * 6/2003 Croft, III ..... H04R 3/00 381/103
7,564,981 B2 * 7/2009 Croft, III ..... G10K 15/02 367/137
7,929,715 B2 * 4/2011 Na ..... H04R 1/323 381/111
8,866,559 B2 * 10/2014 Pompei ..... H03C 3/00 332/145
2001/0007591 A1 7/2001 Pompei
2013/0121500 A1 5/2013 Lamb et al.

FOREIGN PATENT DOCUMENTS

EP 1585364 A1 10/2005

OTHER PUBLICATIONS

International Search Report and the Written Opinion for International App No. PCT/US2015/062207, mailed Feb. 12, 2016, Authorized Officer: Stein, Patricia.

* cited by examiner

*Primary Examiner* — Brenda Bernardi
(74) *Attorney, Agent, or Firm* — Sheppard Mullin Richter & Hampton LLP

(57) ABSTRACT

Systems and methods for removing or reducing distortion in an ultrasonic audio system can include receiving a first audio signal, wherein the first audio signal represents audio content to be reproduced using the ultrasonic audio system; calculating a first error function for the ultrasonic audio system, the first error function comprising an estimate of distortion introduced by reproduction of the audio content by the ultrasonic audio system; transforming the first audio signal into a first pre-conditioned audio signal by combining the first error function with the first audio signal; and modulating the transformed audio signal onto an ultrasonic carrier.

29 Claims, 20 Drawing Sheets

ERROR CORRECTION FOR ULTRASONIC AUDIO SYSTEMS

TECHNICAL FIELD

The disclosed technology relates generally to ultrasonic audio systems and, more specifically, some embodiments relate to error correction systems and methods for ultrasonic audio systems.

DESCRIPTION OF THE RELATED ART

Non-linear transduction results from the introduction of sufficiently intense, audio-modulated ultrasonic signals into an air column. Self-demodulation, or down-conversion, occurs along the air column resulting in the production of an audible acoustic signal. This process occurs because of the known physical principle that when two sound waves with different frequencies are radiated simultaneously in the same medium, a modulated waveform including the sum and difference of the two frequencies is produced by the non-linear (parametric) interaction of the two sound waves. When the two original sound waves are ultrasonic waves and the difference between them is selected to be an audio frequency, audible sound can be generated by the parametric interaction.

Parametric audio reproduction systems produce sound through the heterodyning of two acoustic signals in a non-linear process that occurs in a medium such as air. The acoustic signals are typically in the ultrasound frequency range. The non-linearity of the medium results in acoustic signals produced by the medium that are the sum and difference of the acoustic signals. Thus, two ultrasound signals that are separated in frequency can result in a difference tone that is within the 20 Hz to 20,000 Hz range of human hearing.

BRIEF SUMMARY OF EMBODIMENTS

According to an embodiment of the disclosed technology include systems and methods for error correction in ultrasonic audio systems. In some embodiments, a method for removing or reducing distortion in an ultrasonic audio system, may include receiving a first audio signal, wherein the first audio signal represents audio content to be reproduced using the ultrasonic audio system; calculating a first error function for the ultrasonic audio system, the first error function comprising an estimate of distortion introduced by reproduction of the audio content by the ultrasonic audio system; transforming the first audio signal into a first pre-conditioned audio signal by combining the first error function with the first audio signal; and modulating the transformed audio signal onto an ultrasonic carrier.

In this and other embodiments, the first audio signal received by the system for error correction can be and electronic representation of audio content delivered for playback by the ultrasonic audio system. This can be original unprocessed audio content, or it can be preprocessed audio content process by one or more various techniques. This preprocessing can include, for example, compression, equalization, filtering, and processing for error correction using various error correction techniques. Accordingly, the error correction techniques can be applied directly, or they can be applied in a recursive fashion (whether before or after) with the same, similar, or other error correction techniques.

In various embodiments, the first error function may be $H(x)^2+x^2$, where x is the received first audio signal and H(x) is a Hilbert transform and the inverse of this error function is combined. In various embodiments, the inverse of $H(x)^2+x^2$ is the additive inverse of $H(x)^2+x^2$, and combining the inverse of the first error function with the first audio signal may include adding the inverse of the first error function with the first audio signal. In other embodiments the first error function may include $H(x)^2-x^2$, where x is the received first audio signal and H(x) is a Hilbert transform.

In various embodiments, the operation may further include applying a phase shift or an amplitude adjustment, or both, as a function of frequency, to the first error function before the step of combining to adjust for emitter or filter responses.

In various embodiments, 1, the operation may further include: receiving the first pre-conditioned audio signal; calculating a second error function for the ultrasonic audio system, the second error function comprising a second estimate of distortion introduced by reproduction of the audio content by the ultrasonic audio system; and transforming the pre-conditioned audio signal into a second pre-conditioned audio signal by combining the second error function with the pre-conditioned audio signal; wherein modulating the transformed audio signal onto an ultrasonic carrier may include modulating the transformed pre-conditioned audio signal onto an ultrasonic carrier. One of the first error function and the second error function may include the additive inverse of $H(x)^2+x^2$, and the other of the first error function and the second error function may include $H(x)^2-x^2$, where x is the received audio signal and H(x) is a Hilbert transform.

In some embodiments, the operation may further include applying a phase shift or an amplitude adjustment, or both, as a function of frequency, to one or both of the first and second error functions to adjust for emitter or filter responses.

In various embodiments, the first error function may include $H(x)^2-x^2$, where x is the received first audio signal and H(x) is a Hilbert transform, and the operation may further include an additional cycle of error correction, the additional cycle may include: receiving the transformed audio signal and the first error function for the additional cycle of error correction prior to the modulation; calculating the additive inverse of the first error function; calculating a second error function for the ultrasonic audio system, the second error function comprising $H(x_1)^2-x_1^2$, where $x_1$ is the received transformed audio signal and $H(x_1)$ is a Hilbert transform of the transformed audio signal; combining the second error function with the additive inverse of the first error function to generate a third error function; and transforming the first pre-conditioned audio signal by combining the third error function with the transformed audio signal; wherein the step of modulating the transformed audio signal onto an ultrasonic carrier may include modulating the transformed pre-conditioned audio signal onto an ultrasonic carrier. The first error function may include the additive inverse of $H(x)^2+x^2$, where x is the received first audio signal and H(x) is a Hilbert transform, and the operation may further include an additional cycle of error correction, and the additional cycle may include: receiving the transformed audio signal and the first error function for the additional cycle of error correction prior to the modulation; calculating a second error function for the ultrasonic audio system, the second error function comprising $H(x_1)^2+x_1^2$, where $x_1$ is the received transformed audio signal and $H(x_1)$ is a Hilbert transform of the transformed audio signal; combining the second error function with the additive inverse of the first error function to generate a third error function; and calculating the additive inverse of the third error function; transforming the first pre-conditioned audio signal by combining the additive inverse of the third error function with the transformed audio signal; wherein the step of modulating the transformed audio signal onto an ultrasonic carrier may include modulating the transformed pre-conditioned audio signal onto an ultrasonic carrier.

The first error function may include the additive inverse of $H(x)^2+x^2$, where x is the received first audio signal and H(x) is a Hilbert transform, and the operation may further include an additional cycle of error correction, the additional cycle may include: receiving the transformed audio signal and the first error function for the additional cycle of error correction prior to the modulation; calculating a second error function for the ultrasonic audio system, the second error function comprising the additive inverse of $H(x_1)^2+x_1^2$, where $x_1$ is the received transformed audio signal and $H(x_1)$ is a Hilbert transform of the transformed audio signal; transforming the first pre-conditioned audio signal by combining the second error function with the transformed audio signal; wherein the step of modulating the transformed audio signal onto an ultrasonic carrier may include modulating the transformed pre-conditioned audio signal onto an ultrasonic carrier.

In some embodiments, the first error function may include $H(x)^2-x^2$, where x is the received first audio signal and H(x) is a Hilbert transform, and the operation may further include an additional cycle of error correction, the additional cycle may include: receiving the transformed audio signal and the first error function for the additional cycle of error correction prior to the modulation; calculating a second error function for the ultrasonic audio system, the second error function comprising $H(x_1)^2-x_1^2$, where $x_1$ is the received transformed audio signal and $H(x_1)$ is a Hilbert transform of the transformed audio signal; transforming the first pre-conditioned audio signal by combining the second error function with the transformed audio signal; wherein the step of modulating the transformed audio signal onto an ultrasonic carrier may include modulating the transformed pre-conditioned audio signal onto an ultrasonic carrier.

The first error function may include the additive inverse of $H(x)^2+x^2$, where x is the received first audio signal and H(x) is a Hilbert transform, and the operation may further include applying a phase shift or an amplitude adjustment, or both, as a function of frequency, to the received first audio signal to adjust for emitter or filter responses. The operation may further include applying a phase shift or an amplitude adjustment, or both, as a function of frequency, to the first error function before the step of combining to adjust for emitter or filter responses.

In some embodiments the first error function may include $H(x)^2-x^2$, where x is the received first audio signal and H(x) is a Hilbert transform, and the operation may further include applying a phase shift or an amplitude adjustment, or both, as a function of frequency, to the first received audio signal to adjust for emitter or filter responses. The operation may further include applying a phase shift or an amplitude adjustment, or both, as a function of frequency, to the first error function before the step of combining to adjust for emitter or filter responses.

In still further embodiments, the first error function may include the additive inverse of $H(x)^2+x^2$, where x is the received first audio signal and H(x) is a Hilbert transform, and the operation may further include an additional cycle of error correction, comprising: receiving the transformed audio signal and the first error function for the additional cycle of error correction prior to the modulation; calculating a second error function for the ultrasonic audio system, the second error function comprising the additive inverse of $H(x_1)^2+x_1^2$, where $x_1$ is the received transformed audio signal and $H(x_1)$ is a Hilbert transform of the transformed audio signal; transforming the first pre-conditioned audio signal by combining the second error function with the received first audio signal; wherein the step of modulating the transformed audio signal onto an ultrasonic carrier may include modulating the transformed pre-conditioned audio signal onto an ultrasonic carrier.

In other embodiments, the first error function may include $H(x)^2-x^2$, where x is the received first audio signal and H(x) is a Hilbert transform, and the operation may further include an additional cycle of error correction, comprising: receiving the transformed audio signal and the first error function for the additional cycle of error correction prior to the modulation; calculating a second error function for the ultrasonic audio system, the second error function comprising $H(x_1)^2-x_1^2$, where $x_1$ is the received transformed audio signal and $H(x_1)$ is a Hilbert transform of the transformed audio signal; transforming the first pre-conditioned audio signal by combining the second error function with the first audio signal; wherein the step of modulating the transformed audio signal onto an ultrasonic carrier may include modulating the transformed pre-conditioned audio signal onto an ultrasonic carrier.

In various embodiments, the first error function may include $H(x)^2-x^2$, where x is the received first audio signal and H(x) is a Hilbert transform, and the operation may further include an additional cycle of error correction, the additional cycle may include: receiving the transformed audio signal and the first error function for the additional cycle of error correction prior to the modulation; calculating the additive inverse of the first error function; calculating a second error function for the ultrasonic audio system, the second error function comprising $H(x_1)^2-x_1^2$, where $x_1$ is the received transformed audio signal and $H(x_1)$ is a Hilbert transform of the transformed audio signal; combining the second error function with the additive inverse of the first error function to generate a third error function; and transforming the first pre-conditioned audio signal by combining the third error function with the transformed audio signal; wherein the step of modulating the transformed audio signal onto an ultrasonic carrier may include modulating the transformed pre-conditioned audio signal onto an ultrasonic carrier. Also, the operation may further include applying a phase shift or an amplitude adjustment, or both, as a function of frequency, to the received first audio signal to adjust for emitter or filter responses.

In some other embodiments, the first error function may include the additive inverse of $H(x)^2+x^2$, where x is the received first audio signal and H(x) is a Hilbert transform, and the operation may further include an additional cycle of error correction, the additional cycle may include: receiving the transformed audio signal and the first error function for the additional cycle of error correction prior to the modulation; calculating a second error function for the ultrasonic audio system, the second error function comprising $H(x_1)^2+x_1^2$, where $x_1$ is the received transformed audio signal and $H(x_1)$ is a Hilbert transform of the transformed audio signal; combining the second error function with the additive inverse of the first error function to generate a third error function; and calculating the additive inverse of the third error function; transforming the first pre-conditioned audio signal by combining the additive inverse of the third error function with the transformed audio signal; wherein the step of modulating the transformed audio signal onto an ultrasonic carrier may include modulating the transformed pre-conditioned audio signal onto an ultrasonic carrier. The operation may further include applying a phase shift or an amplitude adjustment, or both, as a function of frequency, to the received first audio signal to adjust for emitter or filter responses.

In still further embodiments, a system for removing or reducing distortion in an ultrasonic audio system, may include: a receiver; an error correction module communicatively coupled to the receiver and configured to (i) accept a first audio signal representing audio content to be reproduced using the ultrasonic audio system; and (ii) calculate a first error function for the ultrasonic audio system, the first error function comprising an estimate of distortion introduced by reproduction of the audio content by the ultrasonic audio system; a summing module configured to transform the first audio signal into a first pre-conditioned audio signal by combining the first error function with the first audio signal. A modulator can also be provided to modulate the signal onto an ultrasonic carrier either before or after the error correction is performed. The system can be configured to perform the methods as set forth above.

Other features and aspects of the disclosed technology will become apparent from the following detailed description, taken in conjunction with the accompanying drawings, which illustrate, by way of example, the features in accordance with embodiments of the disclosed technology. The summary is not intended to limit the scope of any inventions described herein, which are defined solely by the claims attached hereto.

BRIEF DESCRIPTION OF THE DRAWINGS

The technology disclosed herein, in accordance with one or more various embodiments, is described in detail with reference to the following figures. The drawings are provided for purposes of illustration only and merely depict typical or example embodiments of the disclosed technology. These drawings are provided to facilitate the reader's understanding of the disclosed technology and shall not be considered limiting of the breadth, scope, or applicability thereof. It should be noted that for clarity and ease of illustration these drawings are not necessarily made to scale.

The figures are not intended to be exhaustive or to limit the invention to the precise form disclosed. It should be understood that the invention can be practiced with modification and alteration, and that the disclosed technology be limited only by the claims and the equivalents thereof.

DETAILED DESCRIPTION OF THE EMBODIMENTS

Embodiments of the systems and methods described herein provide a Hyper Sound audio system or other parametric or ultrasonic audio system for a variety of different applications. Certain embodiments provide audio reproduction systems using ultrasonic emitters to emit audio-modulated ultrasonic signals and incorporating error correction systems to compensate for harmonic distortion, intermodulation distortion or both.

To provide a foundation for error correction in accordance with the various embodiments, it is useful to discuss distortion. Distortion can be thought of as a signal or sound on the output that differs from what is desired. Nonlinear distortion involves creating tones or frequencies that were not in the input. Many ultrasonic audio delivery systems already exploit nonlinear distortion to create audio from ultrasound. As a result, these systems may be susceptible to unwanted nonlinear distortion. Various embodiments of the technology disclosed herein can be implemented to work to compensate for this distortion by modifying the input audio so that when it is ultimately demodulated in the air, the original input is reproduced as faithfully as practical or possible.

Nonlinear distortion itself appears in two forms: intermodulation distortion and harmonic distortion. Intermodulation distortion is the creation of difference frequencies. For instance, if 2 kHz and 3 kHz created intermodulation distortion, the resulting frequency would be 3 kHz−2 khz=1 khz. Harmonic distortion creates doubles and sums. As above, if given 2 kHz and 3 kHz signals, harmonic distortion would create 3 different frequencies: 2*2=4 khz, 2*3=6 kHz and 2+3=5 kHz. These two types of distortion are both present in typical ultrasonic audio applications, but differ in magnitude and phase.

Figure 1:
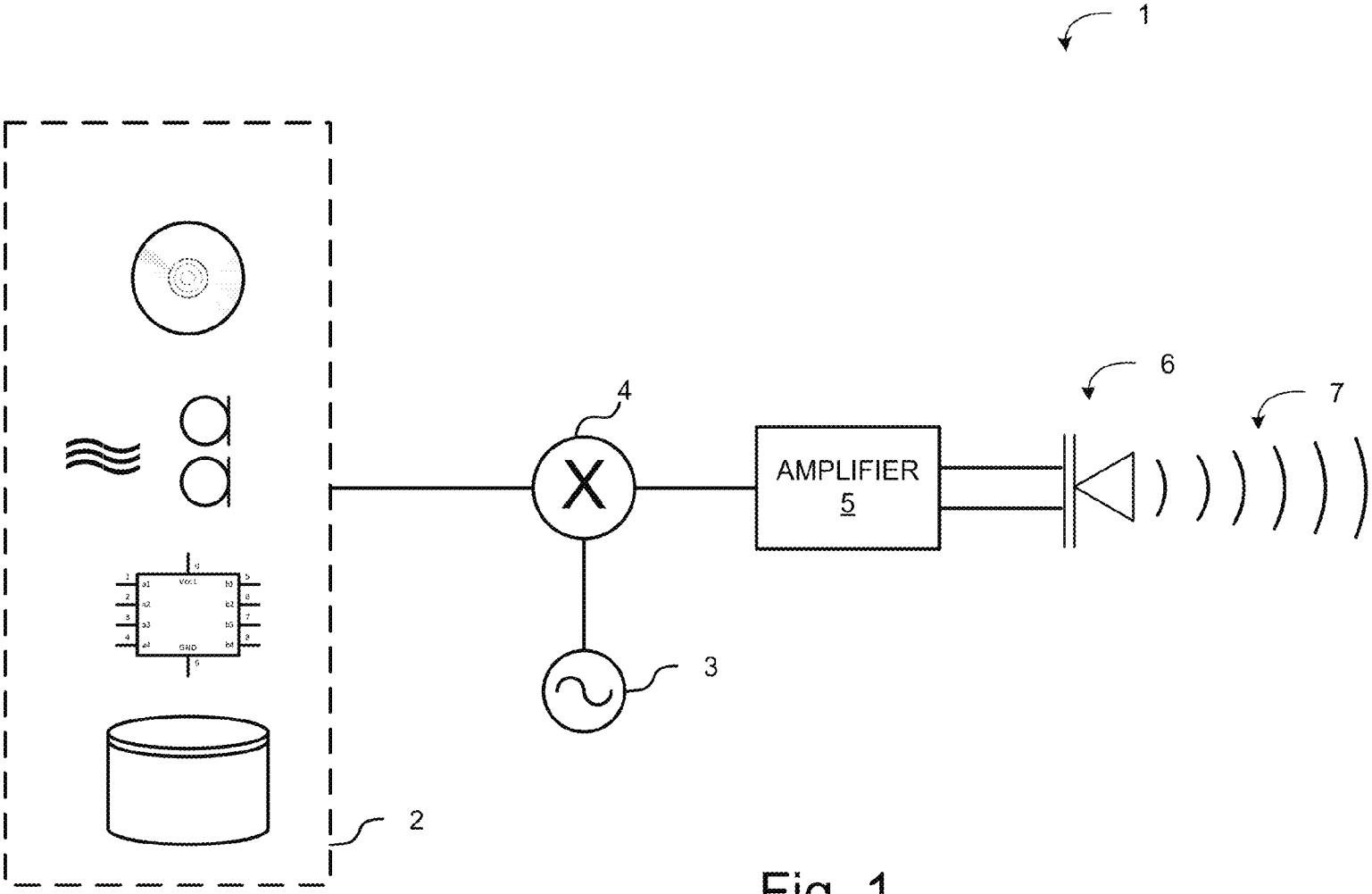
FIG. 1 is a diagram illustrating an ultrasonic sound system suitable for use with the emitter technology described herein.

FIG. 1 is a diagram illustrating an ultrasonic sound system suitable for use in conjunction with the systems and methods described herein. In this exemplary ultrasonic audio system 1, audio content from an audio source 2, such as, for example, a microphone, memory, a data storage device, streaming media source, MP3, CD, DVD, set-top-box, or other audio source is received. The audio content may be decoded and converted from digital to analog form, depending on the source. The audio content received by the ultrasonic audio system 1 is modulated onto an ultrasonic carrier of frequency f1, using a modulator. The modulator typically includes a local oscillator 3 to generate the ultrasonic carrier signal, and modulator 4 to modulate the audio signal on the carrier signal. The resultant signal is a double- or single-sideband signal with a carrier at frequency f1 and one or more side lobes. In some embodiments, the signal is a parametric ultrasonic wave or a HSS signal. In most cases, the modulation scheme used is amplitude modulation, or AM, although other modulation schemes can be used as well. Amplitude modulation can be achieved by multiplying the ultrasonic carrier by the information-carrying signal, which in this case is the audio signal. The spectrum of the modulated signal can have two sidebands, an upper and a lower side band, which are symmetric with respect to the carrier frequency, and the carrier itself.

The modulated ultrasonic signal is provided to the ultrasonic transducer or emitter 6, which launches the ultrasonic signal into the air creating ultrasonic wave 7. When played back through the transducer at a sufficiently high sound pressure level, due to nonlinear behavior of the air through which it is 'played' or transmitted, the carrier in the signal mixes with the sideband(s) to demodulate the signal and reproduce the audio content. This is sometimes referred to as self-demodulation. Thus, even for single-sideband implementations, the carrier is included with the launched signal so that self-demodulation can take place.

Although the system illustrated in FIG. 1 uses a single transducer to launch a single channel of audio content, one of ordinary skill in the art after reading this description will understand how multiple mixers, amplifiers and transducers can be used to transmit multiple channels of audio using ultrasonic carriers. The ultrasonic transducers can be mounted in any desired location depending on the application.

Figure 2:
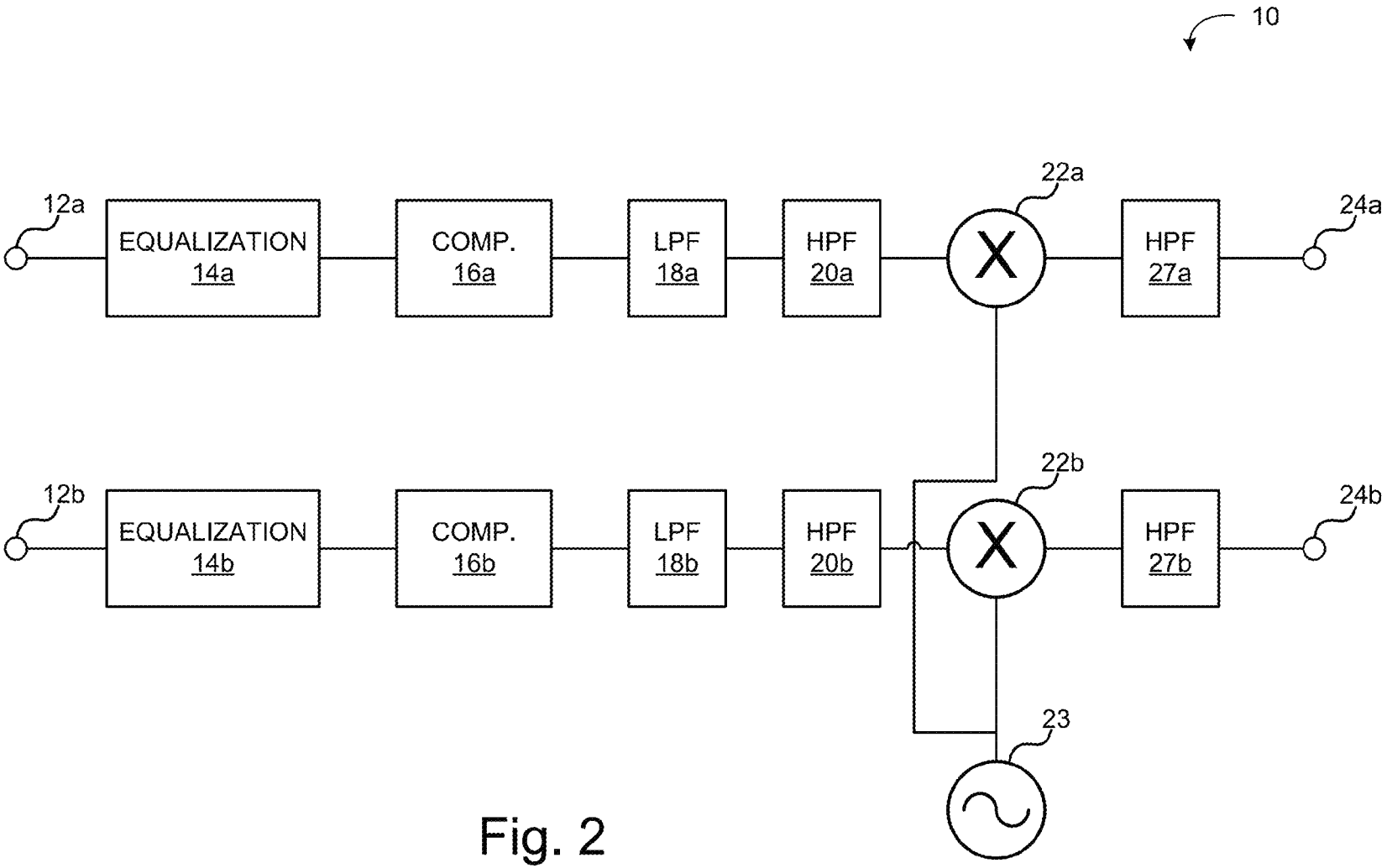
FIG. 2 is a diagram illustrating another example of a signal processing system that is suitable for use with the emitter technology described herein.

One example of a signal processing system 10 that is suitable for use with the technology described herein is illustrated schematically in FIG. 2. In this embodiment, various processing circuits or components are illustrated in the order (relative to the processing path of the signal) in which they are arranged according to one implementation. It is to be understood that the components of the processing circuit can vary, as can the order in which the input signal is processed by each circuit or component. Also, depending upon the embodiment, the processing system 10 can include more or fewer components or circuits than those shown.

Also, the example shown in FIG. 1 is optimized for use in processing two input and output channels (e.g., a "stereo" signal), with various components or circuits including substantially matching components for each channel of the signal. It will be understood by one of ordinary skill in the art after reading this description that the audio system can be implemented using a single channel (e.g., a "monaural" or "mono" signal), two channels (as illustrated in FIG. 2), or a greater number of channels.

Referring now to FIG. 2, the example signal processing system 10 can include audio inputs that can correspond to left 12*a* and right 12*b* channels of an audio input signal. The audio inputs can include, for example, a receiver that receives the audio input. The receiver can include, for example, an input line, circuitry (e.g., forming an op amp or other signal receiver), or any of a number of conventionally available or conventionally used line input receiver. For DSP or other like environments, the received audio input can be digitized for digital processing. Equalizing networks 14*a*, 14*b* can be included to provide equalization of the signal. The equalization networks can, for example, boost or suppress predetermined frequencies or frequency ranges to increase the benefit provided naturally by the emitter/inductor combination of the parametric emitter assembly.

After the audio signals are equalized compressor circuits 16*a*, 16*b* can be included to compress the dynamic range of the incoming signal, effectively raising the amplitude of certain portions of the incoming signals and lowering the amplitude of certain other portions of the incoming signals. More particularly, compressor circuits 16*a*, 16*b* can be included to narrow the range of audio amplitudes. In one aspect, the compressors lessen the peak-to-peak amplitude of the input signals by a ratio of not less than about 2:1. Adjusting the input signals to a narrower range of amplitude can be done to minimize distortion, which is characteristic of the limited dynamic range of this class of modulation systems. In other embodiments, the equalizing networks 14*a*, 14*b* can be provided after compressors 16*a*, 16*b*, to equalize the signals after compression.

Low pass filter circuits 18*a*, 18*b* can be included to provide a cutoff of high portions of the signal, and high pass filter circuits 20*a*, 20*b* providing a cutoff of low portions of the audio signals. In one exemplary embodiment, low pass filters 18*a*, 18*b* are used to cut signals higher than about 15-20 kHz, and high pass filters 20*a*, 20*b* are used to cut signals lower than about 20-200 Hz.

The low pass filters 18*a*, 18*b* can be configured to eliminate higher frequencies that, after modulation, could result in the creation of unwanted audible sound. By way of example, if a low pass filter cuts frequencies above 15 kHz, and the carrier frequency is approximately 44 kHz, the difference signal will not be lower than around 29 kHz, which is still outside of the audible range for humans. However, if frequencies as high as 25 kHz were allowed to pass the filter circuit, the difference signal generated could be in the range of 19 kHz, which is within the range of human hearing.

In the example signal processing system 10, after passing through the low pass and high pass filters, the audio signals are modulated by modulators 22*a*, 22*b*. Modulators 22*a*, 22*b*, mix or combine the audio signals with a carrier signal generated by oscillator 23. For example, in some embodiments a single oscillator (which in one embodiment is driven at a selected frequency of 40 kHz to 150 kHz, which range corresponds to readily available crystals that can be used in the oscillator) is used to drive both modulators 22*a*, 22*b*. By utilizing a single oscillator for multiple modulators, an identical carrier frequency is provided to multiple channels being output at 24*a*, 24*b* from the modulators. Using the same carrier frequency for each channel lessens the risk that any audible beat frequencies may occur.

High-pass filters 27*a*, 27*b* can also be included after the modulation stage. High-pass filters 27*a*, 27*b* can be used to pass the modulated ultrasonic carrier signal and ensure that no audio frequencies enter the amplifier via outputs 24*a*, 24*b*. Accordingly, in some embodiments, high-pass filters 27*a*, 27*b* can be configured to filter out signals below about 25 kHz.

As noted above, when the modulated carrier is transmitted by the transducer at a sufficiently high sound pressure level, the carrier in the signal mixes with the sideband(s) to demodulate the signal and reproduce the audio content. This is sometimes referred to as self-demodulation. Air is predominately a linear medium, but when driven hard enough, it has nonlinear components. This can be represented by an input-output model, $$\mathrm{Air}(x)=A'x+Gx^2, \tag{1}$$

where Air(x) represents the output pressure waves in the air for a given input x. A' is the linear coefficient and G is the nonlinear coefficient. At normal temperatures and pressures, G<<A' which explains why regular audio travels long distances without distortion at regular listening levels.

Parametric audio takes advantage of the second term by using the frequency-mixing effect of the x^2. To illustrate this effect, consider an input, $$x_{in}=A\cos(\omega_1 t)+B\cos(\omega_2 t).$$

Using equation 1, the output in the air is therefore, $$\mathrm{Air}(x_{in})=A'x_{in}+G(A^2\cos^2(\omega_1 t)+B^2\cos^2(\omega_2 t)+2AB\cos(\omega_1 t)\cos(\omega_2 t)). \tag{2}$$

The following trigonometric identities can be used to rewrite this in a more understandable form:

$$\cos^2(\theta)=0.5-0.5\cos(2\theta),\ \cos(a)\cos(b)=0.5(\cos(a-b)+\cos(a+b)).$$

Equation 2 can then be rewritten as (removing DC), $$\mathrm{Air}(x_{in})=A'x_{in}+G(-0.5A^2\cos(2\omega_1 t)-0.5B^2\cos(2\omega_2 t)+AB\cos((\omega_1-\omega_2)t)+AB\cos((\omega_1+\omega_2)t).$$

This shows that using the model given in equation 1, air will reproduce the input frequencies as well as doubles, sums, and differences of the input. If the input is ultrasonic, the only term with a possibility of being audible is the difference tone (bolded). All others are necessarily a higher frequency than the input and therefore inaudible.

Embodiments of the ultrasonic audio system and method can be configured to accept a regular audio input stream and perform a single sideband (SSB) modulation thereon. This effectively adds the input audio frequencies to a carrier reference frequency. As an example, if a baseband audio is a tone at 1 kHz and the selected carrier frequency is 90 kHz, the modulated output is 90 kHz+1 kHz=91 kHz. If this is played alongside an equally loud carrier (at 90 kHz), the difference tone (91 kHz−90 kHz) is exactly 1 kHz and the input is reproduced in the air.

SSB modulation, and its subsequent demodulation in the air, become much more complicated when analyzed with multiple tones. Take for example, a 2-tone input like the example above, but instead of these being ultrasonic frequencies, consider them now to be in the audio band. Applying SSB modulation and adding the carrier tone gives, $$\mathrm{SSB}(x_{in})=0.5\cos(\omega_c t)+A\cos(\omega_c t+\omega_1 t)+B\cos(\omega_c t+\omega_2 t),$$

where $\omega_c$ is the carrier frequency and A+B=0.5 so that the maximum output is +/−1.

A preferred approach is to have the air nonlinearity (eq. 1) to reproduce only 2 tones, $\omega_1$ and $\omega_2$, yet when the model is applied (ignoring all tones outside the audio band), $$\mathrm{Air}(\mathrm{SSB}(x_{in}))=G(0.5A\cos(\omega_1 t)+0.5B\cos(\omega_2 t)+2AB\cos(\omega_1 t-\omega_2 t)),$$

Which illustrates that a 3$^{rd}$ tone is produced at the difference frequency of the input tones. This is intermodulation distortion and is a fundamental consequence of the HSS SSB method.

Systems and methods according to various embodiments are implemented to predict this "error" and pre-distort the input audio to include the predicted error tone 180 degrees out of phase. Including an inverse (180° out of phase or additive inverse) error signal cancels the actual error in the air leaving only the two desired tones. This is the fundamental basis for "error correction" as described herein.

Difference tones proportional to the product of the input coefficients can be generated from an arbitrary input with the following filter, $$\mathrm{Error}_{im}(x)=0.5(x^2+H(x)^2). \tag{3}$$

where H(x) is the Hilbert transform of the input signal.

Applying this to $x_{in}$ will illustrate its result, $$\begin{aligned}
Error_{im}(x_{in}) &= .5\begin{pmatrix} A^2\cos^2(\omega_1 t)+B^2\cos^2(\omega_2 t)+2AB\cos(\omega_1 t)\cos(\omega_2 t)+ \\ A^2\sin^2(\omega_1 t)+B^2\sin^2(\omega_2 t)+2AB\sin(\omega_1 t)\sin(\omega_2 t)\end{pmatrix} \\
&= .5(A^2+B^2+2AB\cos(\omega_1 t)\cos(\omega_2 t)+2AB\sin(\omega_1 t)\sin(\omega_2 t)) \\
&= .5\left(A^2+B^2+2AB\begin{pmatrix}\cos(\omega_1 t-\omega_2 t)+\cos(\omega_1 t+\omega_2 t)+ \\ \cos(\omega_1 t-\omega_2 t)-\cos(\omega_1 t+\omega_2 t)\end{pmatrix}\right) \\
&= .5A^2+.5B^2+AB\cos(\omega_1 t-\omega_2 t).
\end{aligned}$$

Applying a high pass filter to eliminate the DC (the first two terms) will then give the correct frequency and an estimate of the amplitude of the IM distortion signal desired. After adjusting the level and phase (e.g., using empirical measurements), subtracting this from the input signal will cancel the undesired signal. However, after this subtraction, a new frequency is added to the input and new intermodulation distortion frequencies will begin to appear that are related to this new input. Accordingly, various embodiments use a "recursive" error correction technique to compensate for this, at least partially. Applying the error filter from equation 3 to the already 1$^{st}$-order error corrected signal, begins to cancel the unwanted tones created by the first round. As long as the coefficient AB is <1, each subsequent round should continue to improve the total distortion characteristics.

Figure 3:
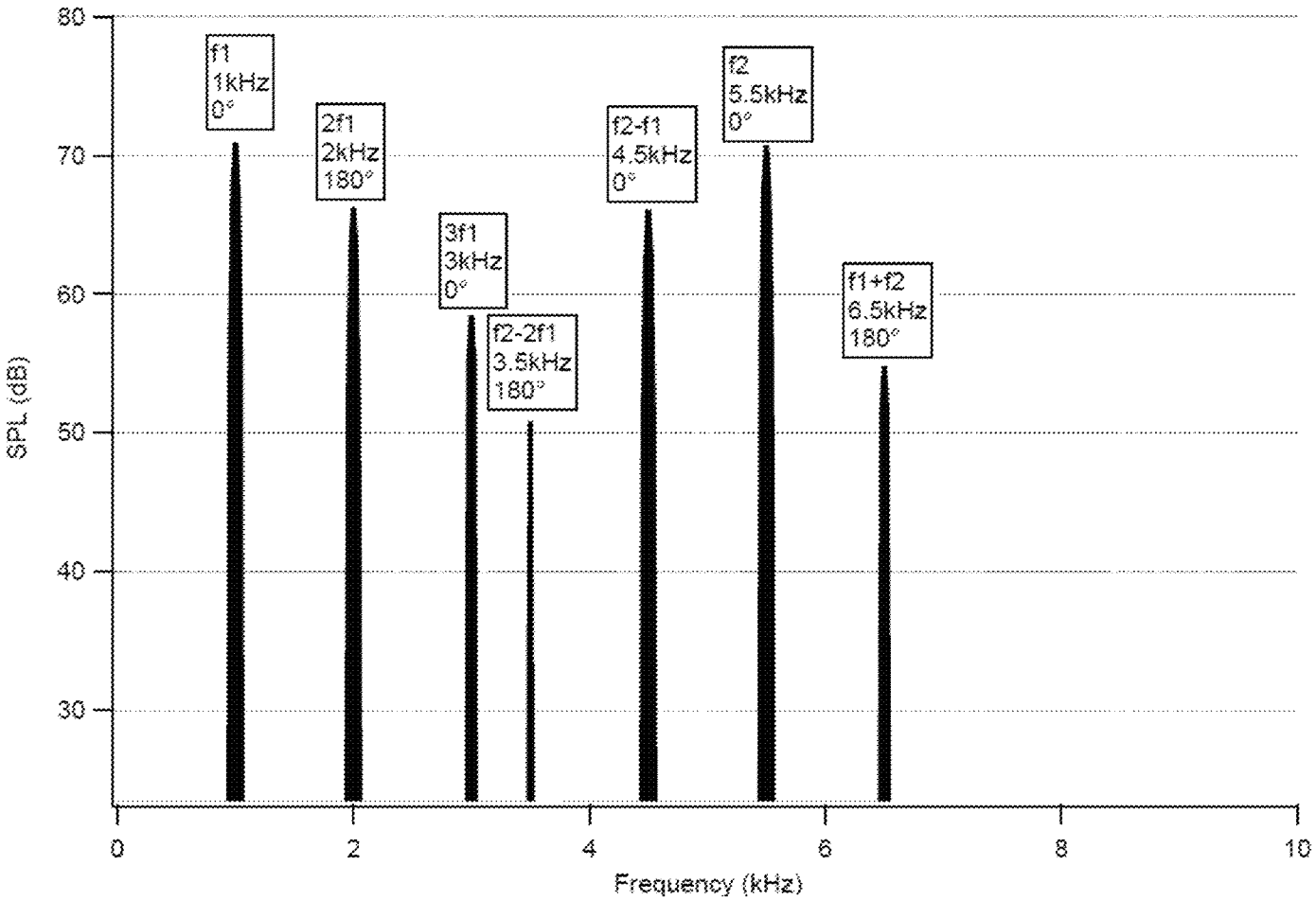
FIG. 3 is a diagram illustrating an example of an uncorrected two-tone input.

This is the theory behind IM distortion. To understand the complications in a real system, reference is now made to FIG. 3. FIG. 3 is a diagram illustrating an example of an uncorrected 2-tone input. In the example of FIG. 3, there are two inputs: f1=1 kHz and f2=5.5 kHz. For them to be the same level, A=0.95 and B=0.05 to compensate for the 12 dB/decade high-pass filter characteristic of air. Listed below each frequency in FIG. 3 is the experimentally determined phase of each tone in relation to the input tones. This represents approximately 75% total harmonic distortion.

As this diagram illustrates, there are several more unwanted tones than just the predicted f2−f1. These are generated by higher order distortion products. For instance, 2f1 can be generated by taking the $4^{th}$ power of $x_{in}$. The relevant term is, $$SSB(x_{in})^4 = \ldots + 0.25A^2 \cos(2\omega_c+2\omega_1)\cos(2\omega_c) + \ldots$$

Figure 4:
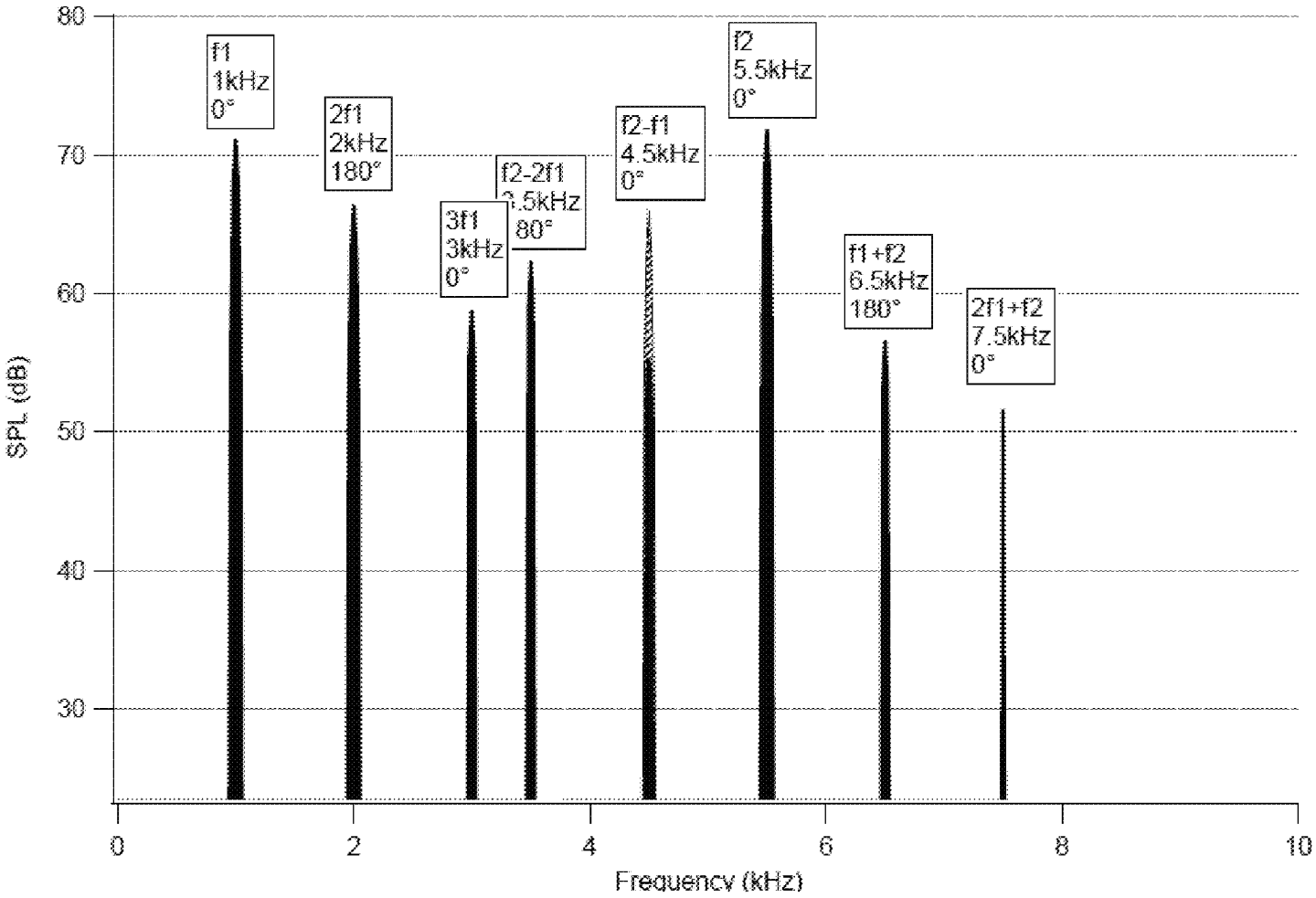
FIG. 4 is a diagram illustrating the effect of one application of the error correction signal (equation 3) in accordance with one embodiment of the technology described herein.

FIG. 4 is a diagram illustrating the effect of 1 application of the error correction signal (equation 3) in accordance with one embodiment of the technology described herein. As can be seen in this diagram, the targeted frequency, f2−f1 is greatly diminished (approximately 10 dB), as shown by the dashed portion of the curve. The new frequency added to the signal results in an increase in f2−2f1 as would be expected.

Figure 5:
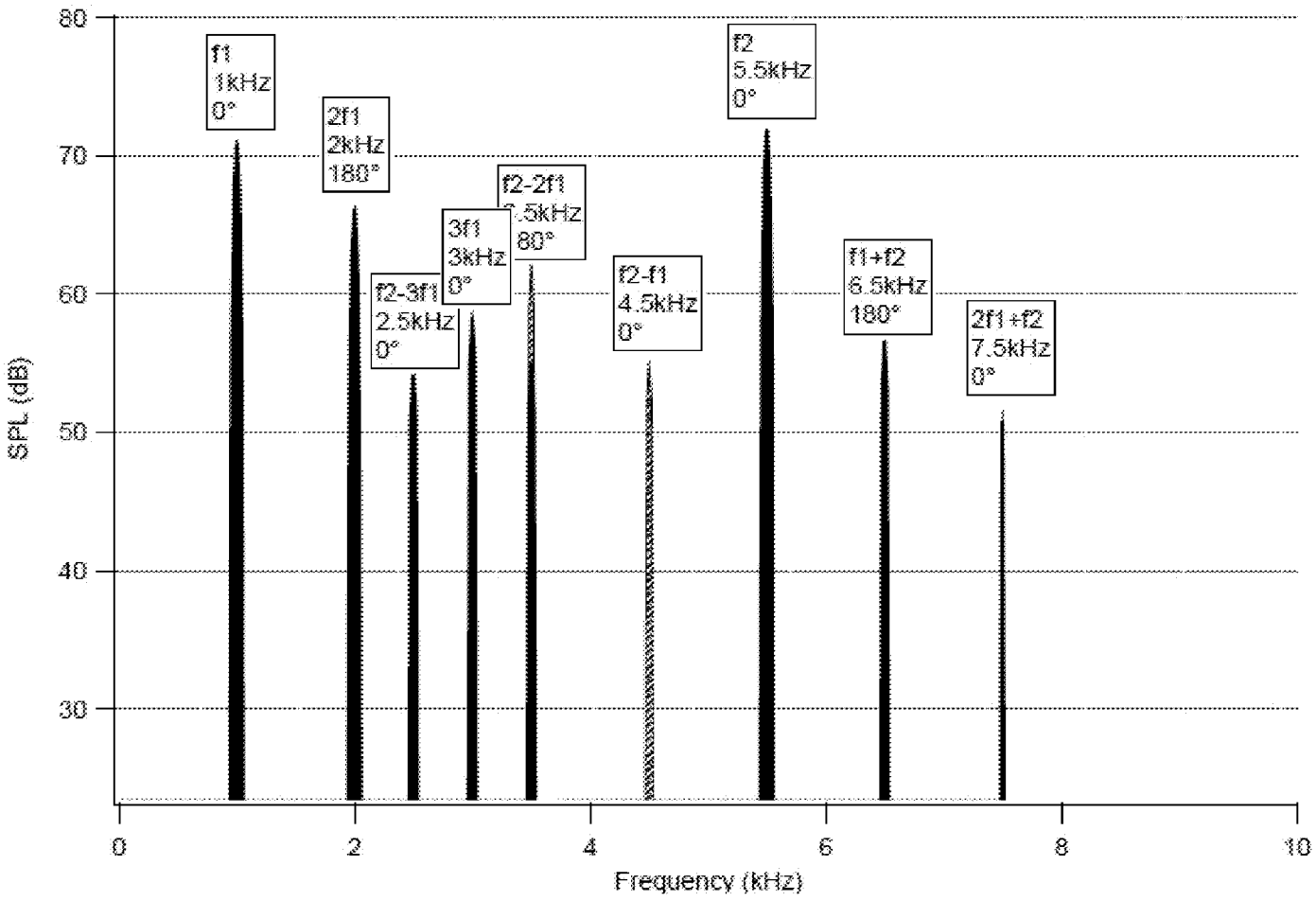
FIG. 5 represents a recursive application of equation 3.

FIG. 5 represents a recursive application of equation 3. It has the desired effect of lowering f2−2f1 but it also lowered f2−f1. This is due to the fact that there is higher-order distortion present. The tone (f2−2f1) added out of phase is lowering the higher-order contribution to f2−f1.

While significantly lowering the IM distortion products, the audio quality is still not perfect. There are harmonic distortion products (doubles and sums) contributing distortion to the output. These can be canceled in a similar manner to the intermodulation products. The error filter to use is given by, $$Error_{har}(x)=0.5(x^2-H(x)^2). \quad (4)$$

Figure 6:
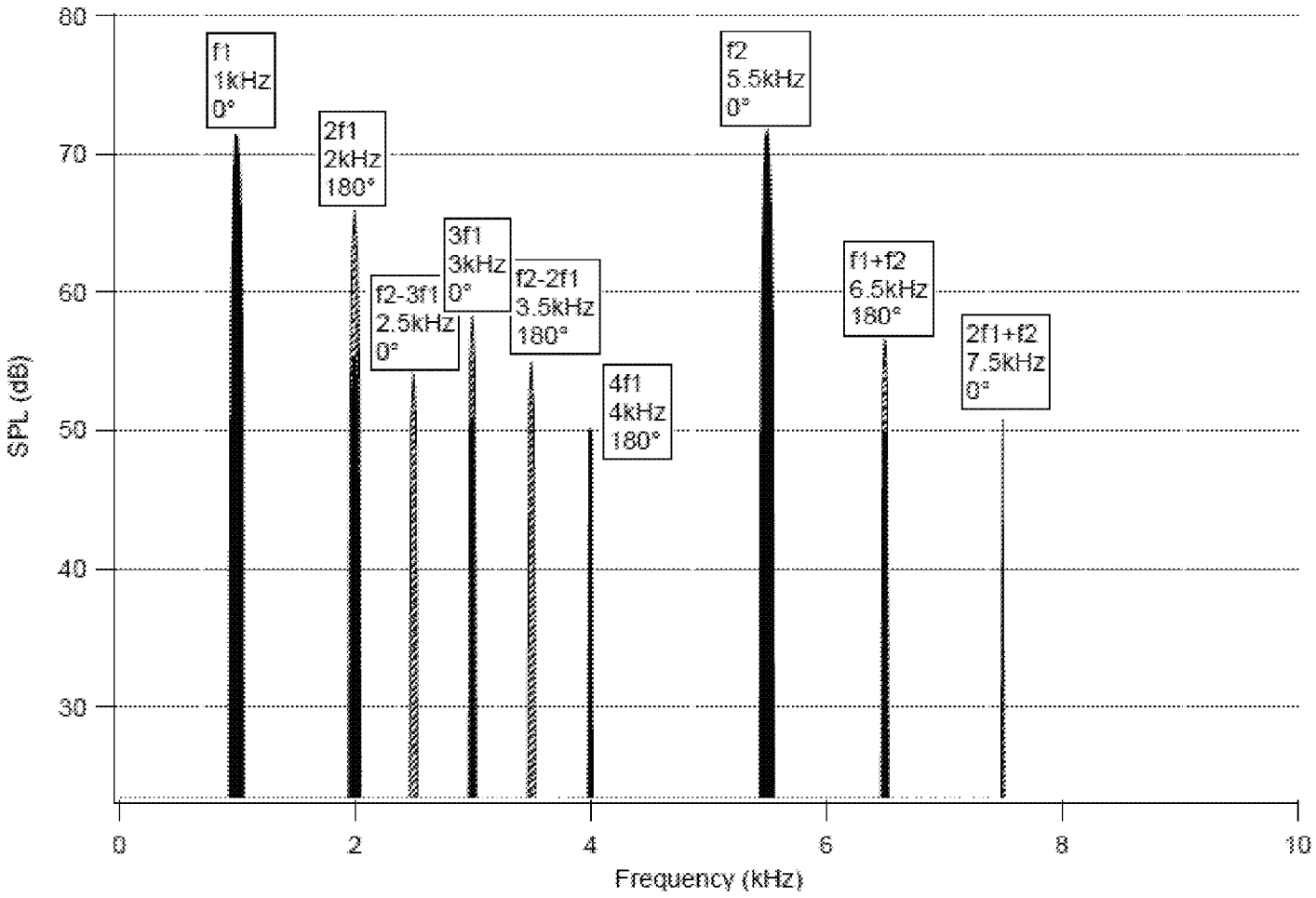
FIG. 6 is a diagram illustrating an example application of equation 4.

This filter generates doubles and sums much in the same manner that equation 3 generates difference frequencies. Note that the distortion products to be canceled with this error term are 180 degrees out of phase to the IM distortion products. Because error terms produced by equation 4 are in phase with the input, they need to be added to the signal to cancel the undesired terms instead of subtracting. The output of one round of adding equation 4 is given in FIG. 6. Particularly, FIG. 6 is a diagram illustrating an example application of equation 4.

As can be seen, the application of equation 4 provides a dramatic reduction to the distortion products as shown by the dashed lines. Not only does it greatly reduce the first-order (doubles and sums) but those resulting corrections reduce higher order products as well.

Figure 7:
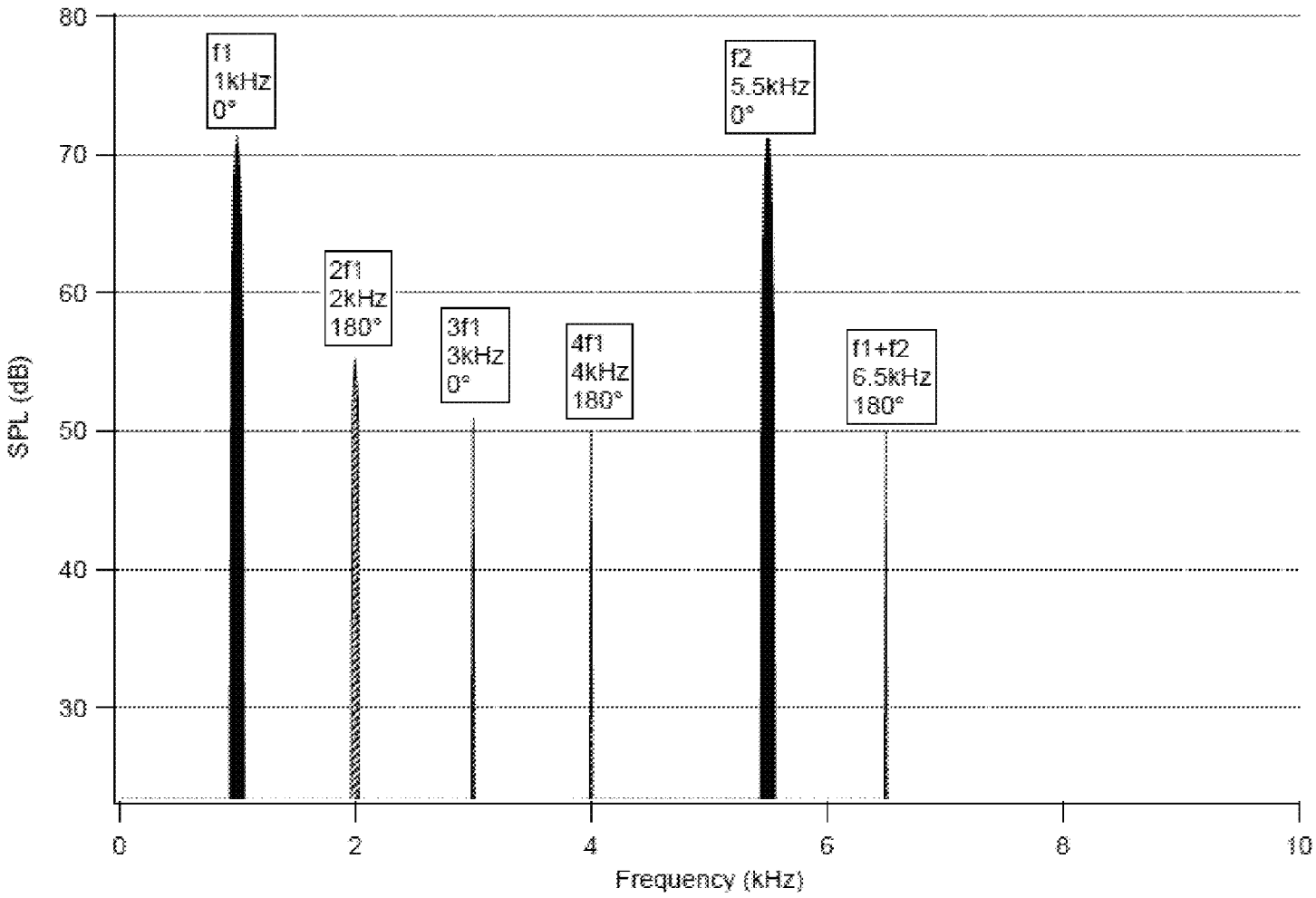
FIG. 7 is a diagram illustrating an example of applying a second round of equation 4.

FIG. 7 is a diagram illustrating an example of applying a second round of equation 4, which in this example, cancels all distortion products. Particularly, the 2f1, 3f1, 4f1 and f1+f2 products have been removed as shown by the dashed lines. In other arrangements, further improvement may be needed and is possible by refining phase characteristics of the error correction.

Experimentally, it is possible to find a system that due to electronic or mechanical factors, will have leftover distortion tones after the 4 applications of error correction exampled above. Each of these tones can be further reduced by direct application at a particular amplitude and phase. At this point, the phase is never 180 or 0 degrees. This implies that phase shifts in the system, either at the emitter or before, prevent the perfect cancellation of unwanted tones.

Having thus described an example of the practical effects of error correction, exemplary embodiments of error correction are now described. Embodiments of the technology disclosed herein can be configured to implement error correction for ultrasonic audio systems in a novel way by separating these two types of nonlinear distortion and correcting for them each individually.

Conventional solutions have used a parametric demodulation distortion model to create an error signal. However, conventional solutions tend to mix both intermodulation and harmonic distortion products. Measurements of ultrasonic audio systems have revealed that intermodulation distortion and harmonic distortion products are not always in phase and indeed may typically be 180 degrees out of phase. Therefore, conventional solutions may reduce some byproducts while increasing others.

The difficulty is that virtually all nonlinear functions (Abs, Log, polynomials, etc.) suffer from the same challenges. Ratios may change between the nonlinear factors but a systematic reduction of distortion products remained elusive. If the input were expected and known, a system could be implemented to shift phases in advance to make the appropriate correction. However, an important goal of error correction is to correct for arbitrary and unknown input.

In accordance with various embodiments, two nonlinear functions have been developed by the inventors and can be used in various embodiments to cope with this problem:

$$IntermodError(x)=H(x)^2+x^2$$

$$HarmonicError(x)=H(x)^2-x^2.$$

Where H(x) is a Hilbert transform, which is a well-known signal processing function, and x is the audio input signal. IntermodError is a nonlinear function, which only produces intermodulation products; and HarmonicError is a nonlinear function, which only produces harmonic distortion products. These functions may be implemented in various embodiments, alone or together, as described herein to provide unexpected results of improving distortion correction beyond conventional approaches. As such, embodiments may be implemented that allow correction for both Harmonic distortion and Intermodulation distortion in a parametric audio system. By separating the two types of distortion into two separate functions, embodiments may be implemented to approach them as two separate error signals. Corrections may be implemented for both error sources, typically yielding better results.

In various embodiments, optimizing the systems may take place empirically. With a microphone in place at a desired distance (at the listening position, for example), test tones may be applied to the system. This can be at a minimum of 2 tones, for example, but there is theoretically no maximum as long as their sums and differences are unique frequencies and can be separated from the background. Multiple series of tones can be used to optimize the system over a wide frequency-range.

Figure 8:
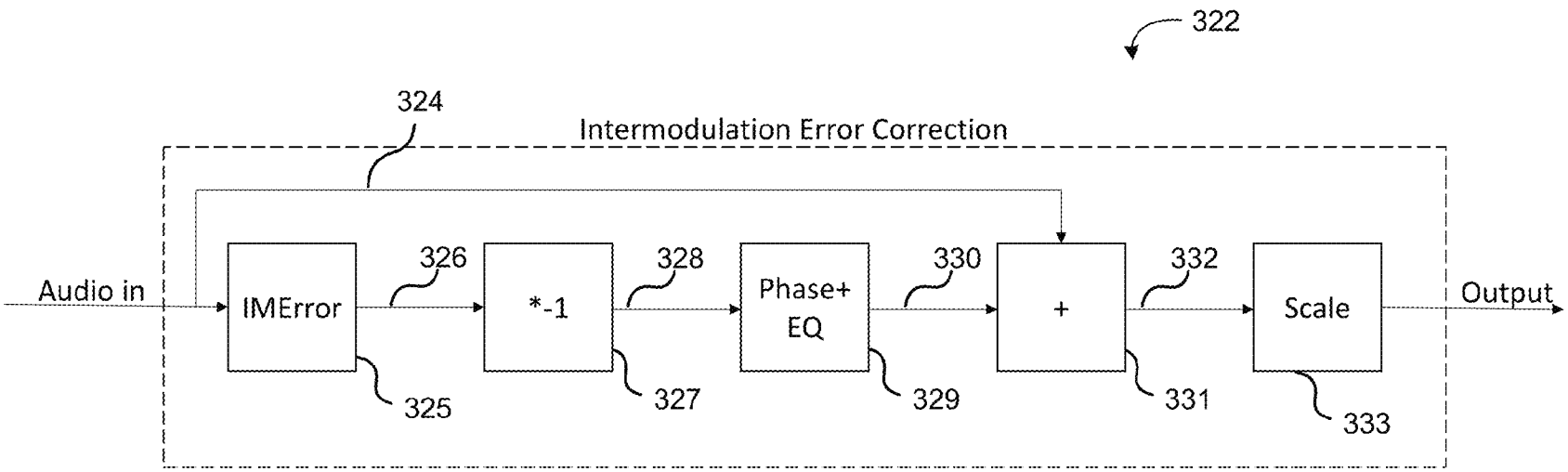
FIG. 8 is a diagram illustrating an example of a signal path of one application of intermodulation error correction in accordance with one embodiment of the technology described herein.

FIG. 8 is a diagram illustrating an example of a signal path of one application of intermodulation error correction in accordance with one embodiment of the technology described herein. This example includes an IMError module 325, an inversion (*−1) module 327, a Phase+EQ module 329, a summing module 331 and a Scaling module 333.

The example of FIG. 8 illustrates an application of Intermodulation (IM) Error correction. The Intermodulation Error Correction Module 322 receives an audio signal representing audio content to be reproduced using the ultrasonic audio system. The received audio input signal can be an analog signal representing audio content to be played over the ultrasonic audio system. In digital implementations, using a DSP for example, the received audio input signal can be a digital signal or it can be converted (e.g., using an analog-to-digital converter, for example) for digital processing.

The Intermodulation Error Correction Module 322 applies the IntermodError(x) function, $H(x)^2+x^2$, set forth above to the input audio signal. The output of the Intermodulation Error Correction Module 322 can proceed directly to the modulator for output to the emitter or can proceed to more additional rounds of error correction.

The first block in this example Intermodulation Error Correction Module 322 is an IMError module 325, which generates an estimate of the error due to intermodulation distortion. This can be referred to as an error signal or error function. This estimated error signal 326 is inverted by inversion module 327 to create an inverted estimated error signal 328. In some embodiments, inversion module 327 is configured to transform the estimated error signal 326 to the additive inverse of the estimated error signal. This effectively changes the sign of estimated error signal 326. This may be accomplished, for example by multiplying the error signal by negative one (e.g., *−1) to change its sign.

The Phase+EQ module 329 can be configured to apply a phase shift or an amplitude adjustment, or both, as a function of frequency to the inverted error signal 328 to adjust for emitter or filter responses. The Phase+EQ module 329 can also serve as a DC blocking filter. The adjustment may be applied to the inverted estimated error signal 328 (after the IM error estimation is computed) as shown. It can be applied using linear filters and the application made by adjusting a table of coefficients (such as, for example, in a DSP). The coefficients can be adjusted based on the results obtained. For example, distortion measurements can be made and adjustments made based on the results obtained.

As a further example, a microphone can be placed at the output to pick up the audio resulting from the signal emitted by the emitter (not shown), distortion measurements made and the Phase+Eq adjustments made accordingly. For example, this can be accomplished using a series of tones as the audio input, and measuring the distortion based on the reproduction of those tones by the emitter. The feedback and adjustment can be configured in some embodiments to run in real time (e.g., all the time) to optimize the adjustments on an ongoing basis during operation of the audio system. For example, a Fourier transform can be applied the audio signal and frequency components determined therefrom and the distortion determined by analyzing these frequency components. In various embodiments, the Phase+EQ can be implemented as a series of finite impulse response (FIR) filters, infinite impulse response (IIR) filters, or some other digital filters, which can be implemented, for example, using a DSP or other digital techniques. In another embodiment, the Phase+EQ could be implemented with analog circuitry outside of a DSP.

The adjusted signal 330 (e.g., the inverted error function with equalization applied) is combined with the audio input 324, transforming the audio signal into a pre-conditioned audio signal by combining the inverted error function with the audio signal. In embodiments where the inverted error signal 328 is the additive inverse of the estimated error signal 326, the combination is performed by adding the inverted error signal 328 (e.g., as adjusted by Phase+EQ module 329) to the original audio signal to effectively subtract the noise estimate from the signal. This can be accomplished by summing module 331. Accordingly, the output signal is the audio signal minus the estimated error, with some scaling as described below. When the actual error is introduced, the original audio signal, without error (or with a lesser amount of error depending on the quality of the estimate and Phase+EQ adjustments) results.

The pre-conditioned audio signal can also be referred to as a pre-corrected audio signal. In various embodiments, the error function, or error signal can be thought of as an estimation of the error that will be introduced into the reproduced audio, in this case the intermodulation error. Accordingly, combining the audio signal with the additive inverse of this estimated error creates a pre-conditioned signal, which, when subjected to the actual error (again, in this case, intermodulation distortion) should effectively 'cancel' this actual error to some extent. As noted elsewhere in this document, multiple recursions can be performed to further reduce or even eliminate the error. This similarly applies to the harmonic distortion as well, in which the signal is pre-conditioned for estimated or predicted errors due to harmonic distortion.

The summed output (e.g., effectively subtracted), in some embodiments, is provided to scaling module 333. The scaling module can be configured to multiply the combined signal 332 by a constant. This can be configured to adjust the output to a known maximum output as the error correction can cause the output to exceed the input. The scaling module can also be configured to react, real-time, to adjust the signal for output while avoiding exceeding full-scale. In another embodiment, the scaling module can adjust the output to match the average (e.g., RMS) of the input signal and simultaneously avoiding going over full-scale. In another embodiment, the scaling module can adjust the output to match the maximum of the input signal, which by definition will never be over full-scale. In another embodiment, the scaling module can act as a dynamic range compressor that applies gain to lower-volume input but not near-full-scale content.

With a microphone set up to distinguish unwanted intermodulation tones from given input test tones, the Phase+EQ settings may be adjusted using Phase+EQ module 329 to reduce or minimize unwanted tones in the output. This can include removing any DC component present in the system. As a result, the distortion in the output can be reduced. After compensating for intermodulation distortion optimally, the output of this function can fed to the harmonic distortion algorithm shown in FIG. 9.

Figure 9:
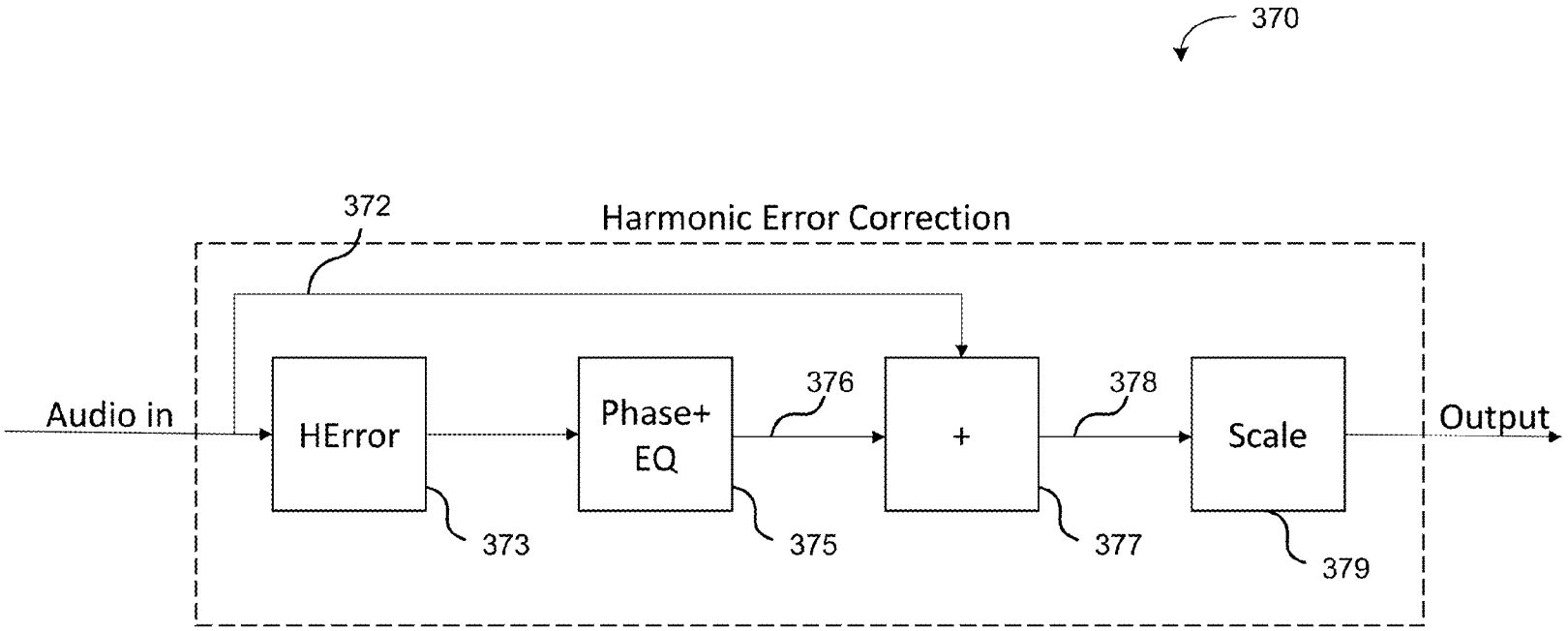
FIG. 9 illustrates an example application of Harmonic Distortion Error Correction in accordance with one embodiment of the technology described herein.

FIG. 9 illustrates an example application of Harmonic Distortion Error Correction in accordance with one embodiment of the technology described herein. In this example, Harmonic Error Correction Module 370 includes an HError module 373, Phase+EQ module 375, a summing module 377 and a scaling module 379. The output of the Harmonic Error Correction Module 370 can proceed directly to the modulator for output to the emitter or can proceed to more rounds of error correction.

The Harmonic Error Correction Module 370 receives an audio signal representing audio content to be reproduced using the ultrasonic audio system. The received audio input signal can be an analog signal representing audio content to be played over the ultrasonic audio system. In digital implementations, using a DSP for example, the received audio input signal can be a digital signal or it can be converted (e.g., using an analog-to-digital converter, for example) for digital processing.

HError module 373 can be configured to apply the HarmonicError(x) function, $H(x)^2-x^2$ to generate an estimate of the harmonic distortion error 374 introduced by the audio system. The Phase+EQ module 375 can be configured to apply a phase shift or an amplitude adjustment, or both, as a function of frequency to adjust for emitter or filter responses. The Phase+EQ module 375 can also serve as a DC blocking filter. The adjustment may be applied to the corrected signal (after the harmonic distortion error correction is applied) as shown. It can be applied using linear filters and the application made by adjusting a table of coefficients (such as, for example, in a DSP). The coefficients can be adjusted based on the results obtained. For example, distortion measurements can be taken and adjustments made based on the results obtained. As a further example, a microphone can be placed at the output to pick up the audio resulting from the signal emitted by the emitter (not shown), distortion measurements made and the Phase+Eq adjustments made accordingly. For example, this can be accomplished using a series of tones as the audio input, and measuring the distortion based on the reproduction of those tones by the emitter. The feedback and adjustment can be configured in some embodiments to run in real time (e.g., all the time) to optimize the adjustments on an ongoing basis during operation of the audio system. For example, a Fourier transform can be applied the audio signal and frequency components determined therefrom and the distortion determined by analyzing these frequency components.

The adjusted signal 376 is summed with the audio input 372 at summing module 377. The summed output is provided to scaling module 379. The scaling module can be configured to multiply the combined signal 378 by a constant. This can be configured to adjust the output to a known maximum output as the error correction can cause the output to exceed the input. The scaling module can also be configured to react, real-time, to adjust the signal for output while avoiding exceeding full-scale. In another embodiment, the scaling module can adjust the output to match the average (e.g., RMS) of the input signal and simultaneously avoiding going over full-scale. In another embodiment, the scaling module can adjust the output to match the maximum of the input signal, which by definition will never be over full-scale. In another embodiment, the scaling module can act as a dynamic range compressor that applies gain to lower-volume input but not near-full-scale content.

Again, Phase+EQ for this stage can be adjusted using data from the microphone to reduce or minimize unwanted tones. This block may be different from the equivalent step in the intermodulation error correction. While intermodulation distortion is primarily created by the air, harmonic distortion is primarily generated within the electrical components and emitter. As a result, the Phase+EQ necessary for optimal performance for these two corrections can be substantially different. For instance, the magnitude of the correction needed to correct for harmonic distortion might be much less than that needed to correct for intermodulation distortion. In another instance, the phase of an analog filter within the amplifier may be corrected here but not necessarily in the intermodulation correction.

As noted above, in some embodiments corrections for both harmonic distortion and intermodulation distortion may be applied. The correction may be improved further by recursively adding additional applications of the error correction algorithms. Because the application of ItermodError (x) or HarmonicError(x) actively adds signal, it can add small amounts of distortion itself. Applying the algorithm a second time will reduce this distortion. Typically, for each recursive application of the error correction, the added distortion will be progressively less.

Figure 10:
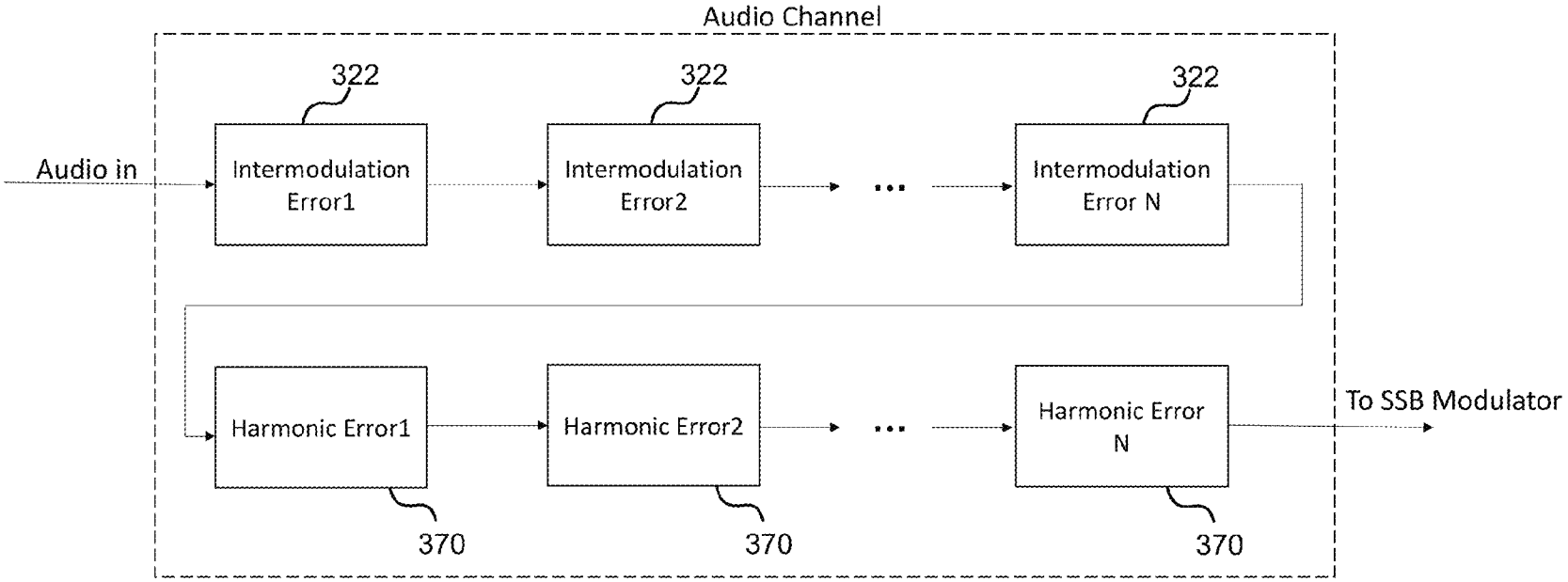
FIG. 10 is a diagram illustrating an example of recursively applying multiple rounds of error correction in accordance with one embodiment of the technology described herein.

FIG. 10 is a diagram illustrating an example of recursively applying multiple rounds of error correction in accordance with one embodiment of the technology described herein. Applying multiple rounds can aid in achieving optimal output. Each round may have different values for Phase+EQ and Scaling, which may be all set sequentially via empirical measurement.

Any chosen number of both Intermodulation and Harmonic Distortion Error Correction modules may be used. In some embodiments, the number of rounds is limited only by computing power. In this example, Intermodulation Error is corrected for first (intermodulation error correction modules 322), followed by Harmonic Distortion Error correction (harmonic error correction modules 370). In another embodiment, Harmonic Distortion Error Correction could proceed first followed by Intermodulation Distortion Error Correction. Also, they may be interleaved by, for example, applying one or more applications of intermodulation error correction, followed by one or more applications of harmonic distortion error correction, followed by a second application of intermodulation error correction, and so on (or they may be interleaved in the opposite order). In various embodiments, each error correction module 322, 370 can be implemented using, for example, the modules shown in FIGS. 8 and 9, respectively.

Figure 11:
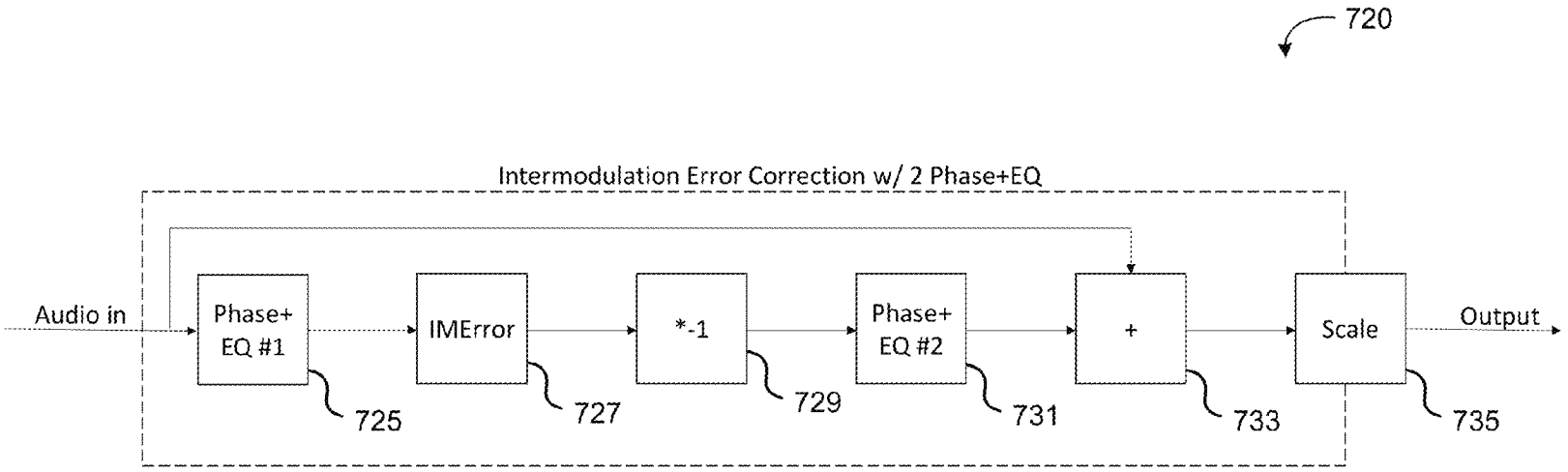
FIG. 11 is a diagram illustrating an example block for basic intermodulation error correction in accordance with one embodiment of the technology described herein.

FIG. 11 is a diagram illustrating an example block for basic intermodulation error correction in accordance with one embodiment of the technology described herein. In this example, Intermodulation Error Correction Module 720 operates similarly to Intermodulation Error Correction Module 322 as shown above in FIG. 8, but is illustrated as having two Phase+EQ modules 725, 731. In this example, the Phase+EQ modules 725, 731 represent an application of frequency dependent amplitude and/or phase alteration. These can be implemented, for example, as discussed above with reference to FIG. 8. Either or both of the Phase+EQ modules 725, 731 can be tuned to have no effect (passing the signal without modification) if they are not needed. This can be done, for example, to save on the computation costs.

IMError module 727 applies the Intermodulation Error function, which can be applied as described above with reference to FIG. 8. Inversion module 729 can be implemented to provide the additive inverse of the estimated error signal, and a summing module provided to add the inverted signal (e.g., subtract the estimated error signal) from the audio signal, as also described above with reference to FIG. 8.

The Scale module 735 represents a multiplicative constant, which can be applied to correct for over-scale output as a result of the error correction. Scale module 735 may also be implemented as described above with reference to FIG. 8.

Figure 12:
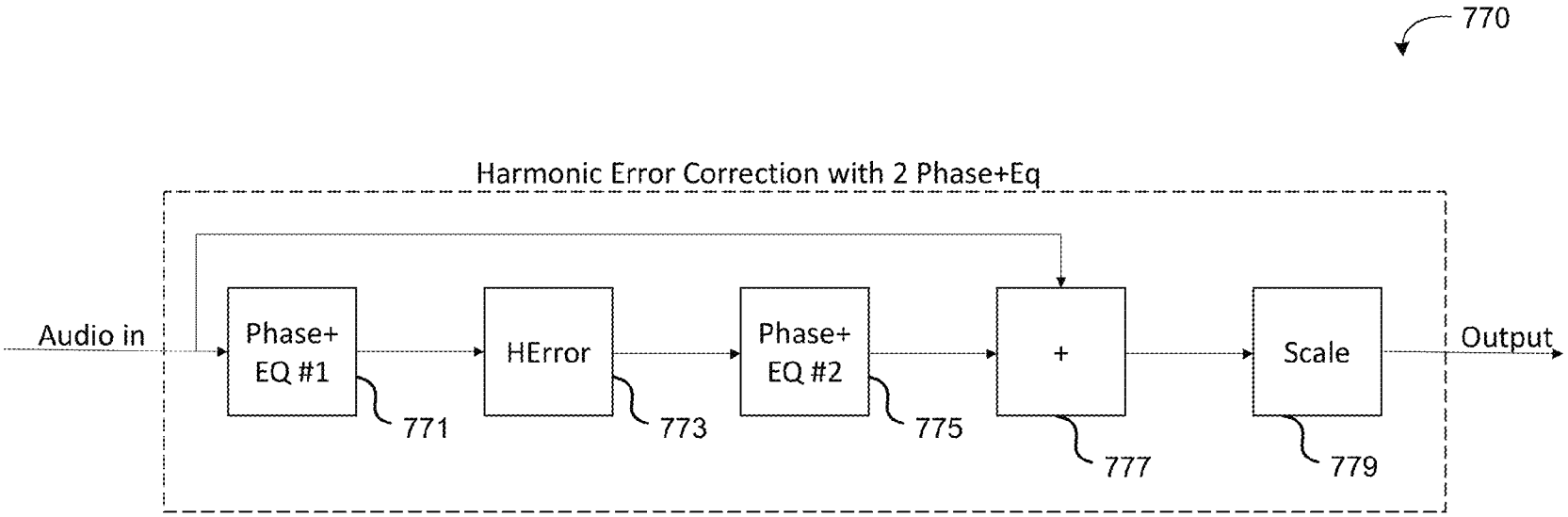
FIG. 12 is a diagram illustrating an example block for basic harmonic distortion error correction in accordance with one embodiment of the technology described herein.

FIG. 12 is a diagram illustrating an example block for basic harmonic distortion error correction in accordance with one embodiment of the technology described herein. In this example, Harmonic Error Correction Module 770 operates similarly to Harmonic Error Correction Module 370 as shown above in FIG. 9, but is illustrated as having two Phase+EQ modules 771, 775. The Phase+EQ modules 771, 775 represent an application of frequency dependent amplitude and/or phase alteration. These can be implemented, for example, as discussed above with reference to FIG. 9. Either or both of the Phase+EQ modules 771, 775 can be tuned to have no effect (passing the signal without modification) if they are not needed. This can be done, for example, to save on the computation costs.

Harmonic distortion error module 773 applies the Harmonic Distortion Error function, which can be applied as described above with reference to FIG. 9. The scaling module 779 represents a multiplicative constant, which can be applied to correct for over-scale output as a result of the error correction. The scaling module 779 can be configured to multiply the signal by a constant. This can be configured to adjust the output to a known maximum output as the error correction can cause the output to exceed the input. The scaling module can also be configured to react, real-time, to adjust the signal for output while avoiding going over full-scale. In another embodiment, the scaling module can adjust the output to match the average (RMS) of the input signal and simultaneously avoiding going over full-scale. In another embodiment, the scaling module can adjust the output to match the maximum of the input signal, which by definition will never be over full-scale. In another embodiment, the scaling module can act as a dynamic range compressor that applies gain to lower-volume input but not near-full-scale content.

Figure 13:
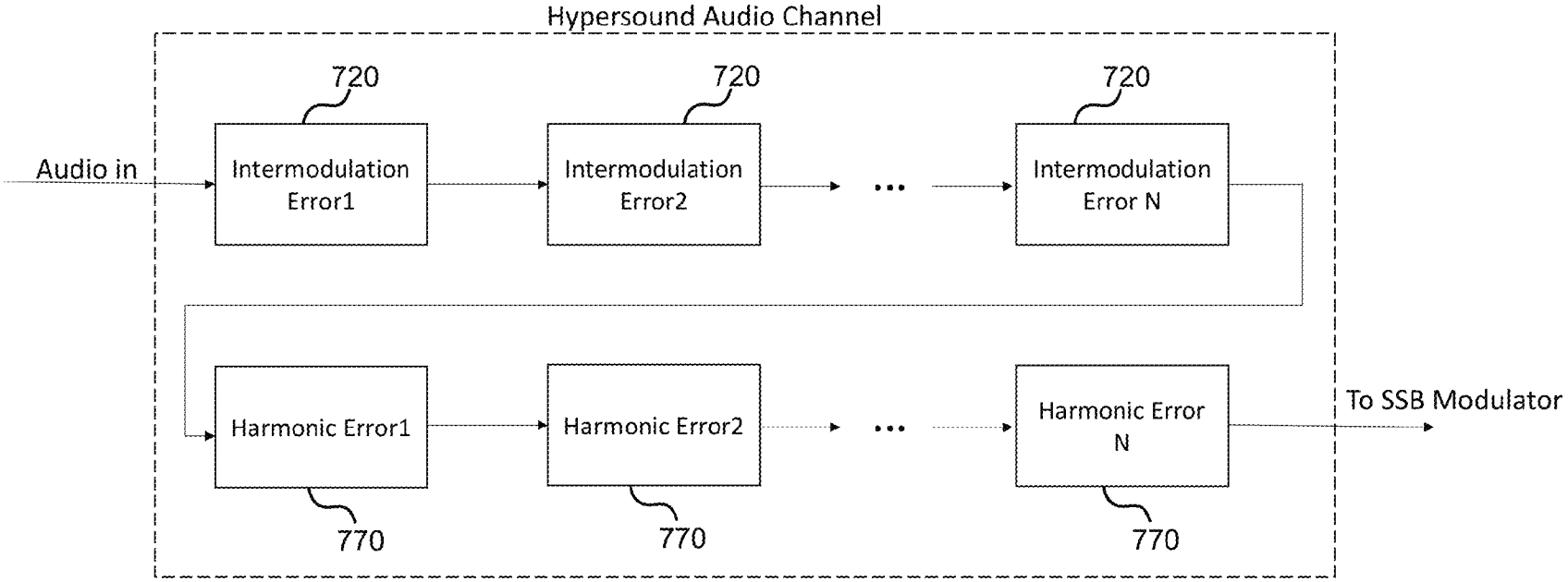
FIG. 13 is a diagram illustrating an example of a recursive application of intermodulation error correction and harmonic error correction in accordance with one embodiment of the technology described herein.

As with the embodiments described above with respect to FIGS. 8 and 9, and similar to that as shown in FIG. 10, the filter shown in FIGS. 11 and 12 can be applied recursively in series to further reduce distortion. FIG. 13 is a diagram illustrating an example of a recursive application of intermodulation error correction and harmonic error correction in accordance with one embodiment of the technology described herein. In this application, intermodulation correction is applied first, N times, followed by harmonic corrections, N times. The number of applications of each correction need not be the same, and the order does not need to follow the order is shown in FIG. 13. In other words harmonic distortion error correction can be applied first, followed by intermodulation error correction. Also, they may be interleaved with one or more applications of intermodulation error correction, followed by one or more applications of harmonic distortion error correction, followed by a second application of intermodulation error correction, and so on. In this and other recursive embodiments, each round may have different values for Phase+EQ and Scaling, which may be all set sequentially via empirical measurement.

Figure 14:
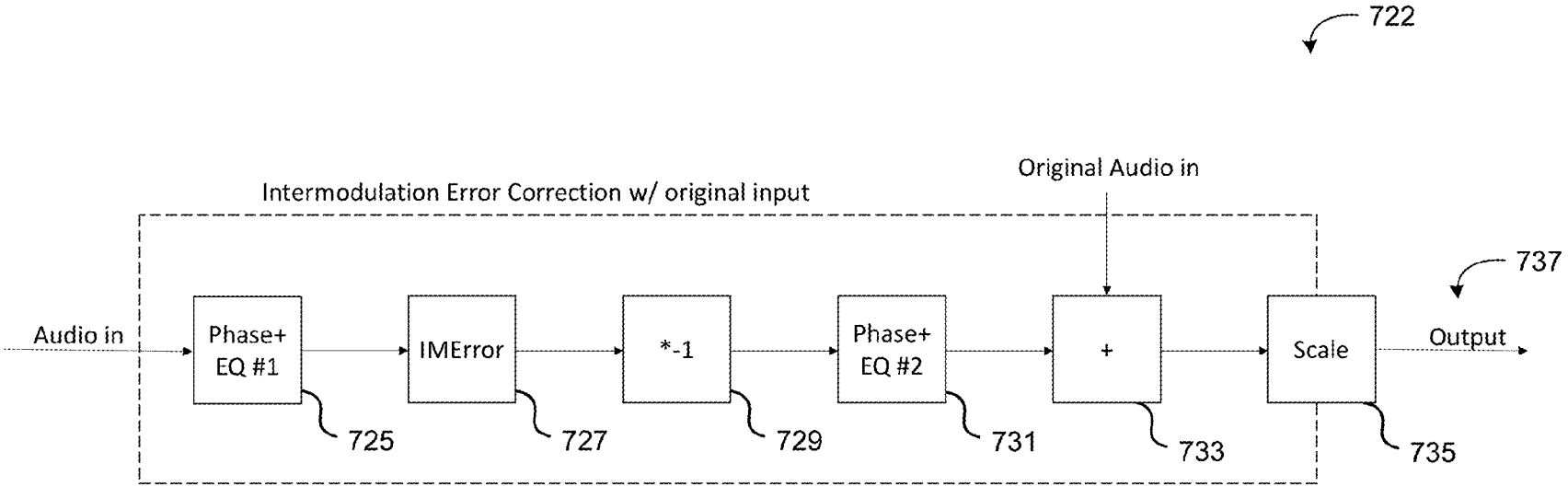
FIG. 14 is a diagram illustrating an example of intermodulation distortion correction utilizing the original audio input as an input to the recursion process in accordance with one embodiment of the technology described herein.
Figure 15:
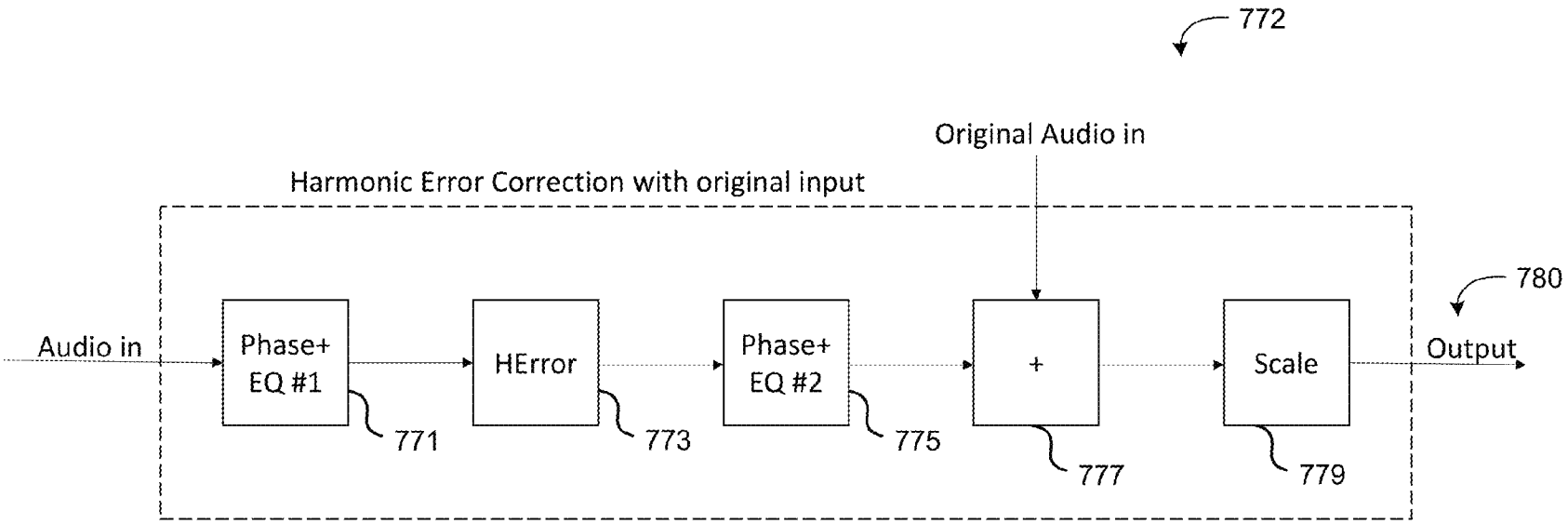
FIG. 15 is a diagram illustrating an example of harmonic distortion error correction utilizing the original audio input as an input to the recursion process in accordance with one embodiment of the technology described herein.
Figure 16:
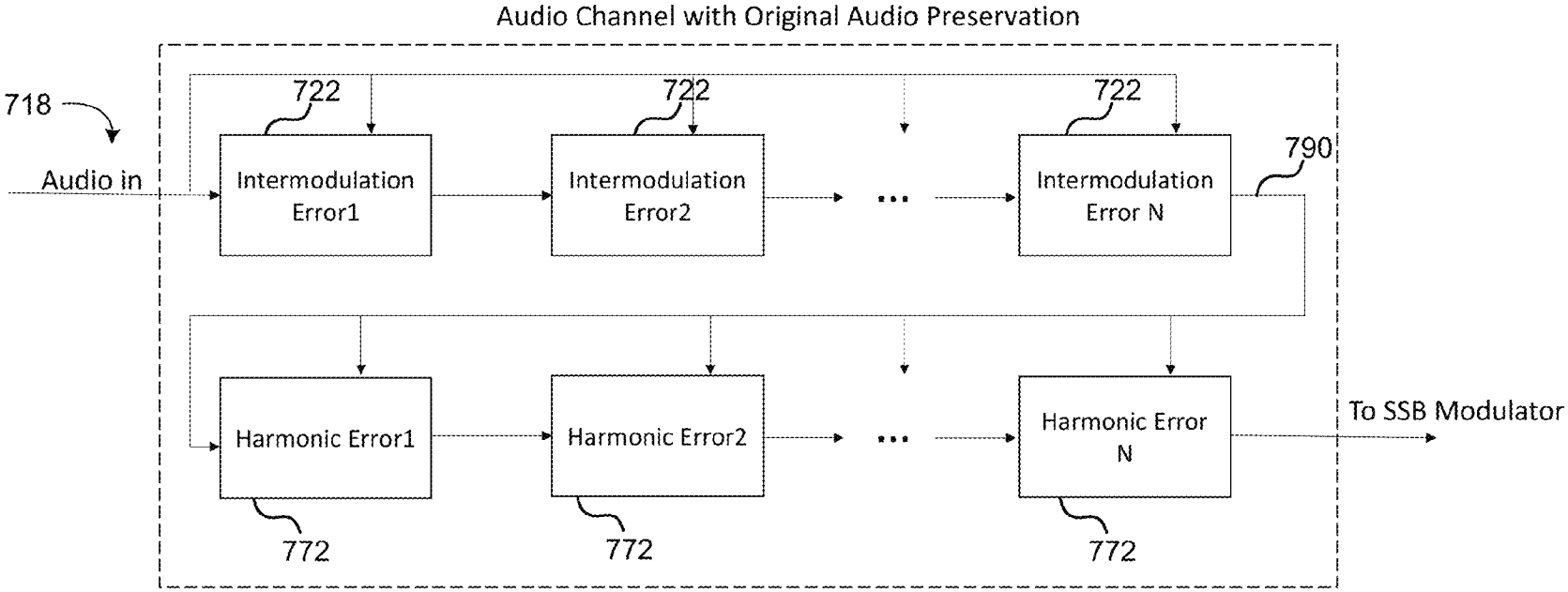
FIG. 16 is a diagram illustrating an example of recursive processing using the original audio input (i.e., non feed-forward) in accordance with one embodiment of the technology described herein.

FIGS. 14, 15 and 16 are diagrams illustrating examples of intermodulation error correction in accordance with one embodiment of the technology disclosed herein. Particularly, these examples apply the original audio input into the correction process.

FIG. 14 is a diagram illustrating an example of an intermodulation distortion correction module 722 utilizing the original audio input as an input to the recursion process in accordance with one embodiment of the technology described herein. If this is the first block in the recursion, "Audio in" and "Original Audio in" are the same signal. In the case of subsequent recursions, "Audio in" represents the output 737 of the previous intermodulation error correction block. Other blocks can be implemented in various embodiments using the same or similar modules 725, 727, 729, 731, 733, at 735 as described above with reference to FIG. 11.

FIG. 15 is a diagram illustrating an example of a harmonic distortion error correction module 772 utilizing the original audio input as an input to the recursion process in accordance with one embodiment of the technology described herein.

If this is the first block in the recursion, "Audio in" and "Original Audio in" are the same signal. In the case of subsequent recursions, "Audio in" represents the output 780 of the previous intermodulation error correction block. Other blocks can be implemented in various embodiments using the same modules 771, 773, 775, 777, and 779, as described above with reference to FIG. 12.

FIG. 16 is a diagram illustrating an example of recursive processing using the original audio input in accordance with one embodiment of the technology described herein. Notice that the "Original Audio in" 790 for the harmonic error correction is not the absolute original audio input 718, but instead the input 790 to the start of the chain of harmonic recursions. As with the previous embodiment of recursive error correction, the order of application of intermodulation and harmonic error correction can be reversed with the input to the second correction scheme serving as the "Original Audio in" for that correction scheme. Interleaving these corrections can also be implemented, but it should be implemented in pairs (e.g., a pair of intermodulation error correction modules 722 followed by a pair of harmonic error correction modules 772, and so on, or vice versa), otherwise it does not significantly differ from FIG. 15. Again, in this and other recursive embodiments, each round may have different values for Phase+EQ and Scaling, which may be all set sequentially via empirical measurement.

Another example embodiment involving feed-forward error is now described. This was detailed in a previous document for harmonic distortion error correction. Shown in FIGS. 17, 18 and 19 are the feed-forward block diagrams illustrating examples of both harmonic and intermodulation error correction.

Figure 17:
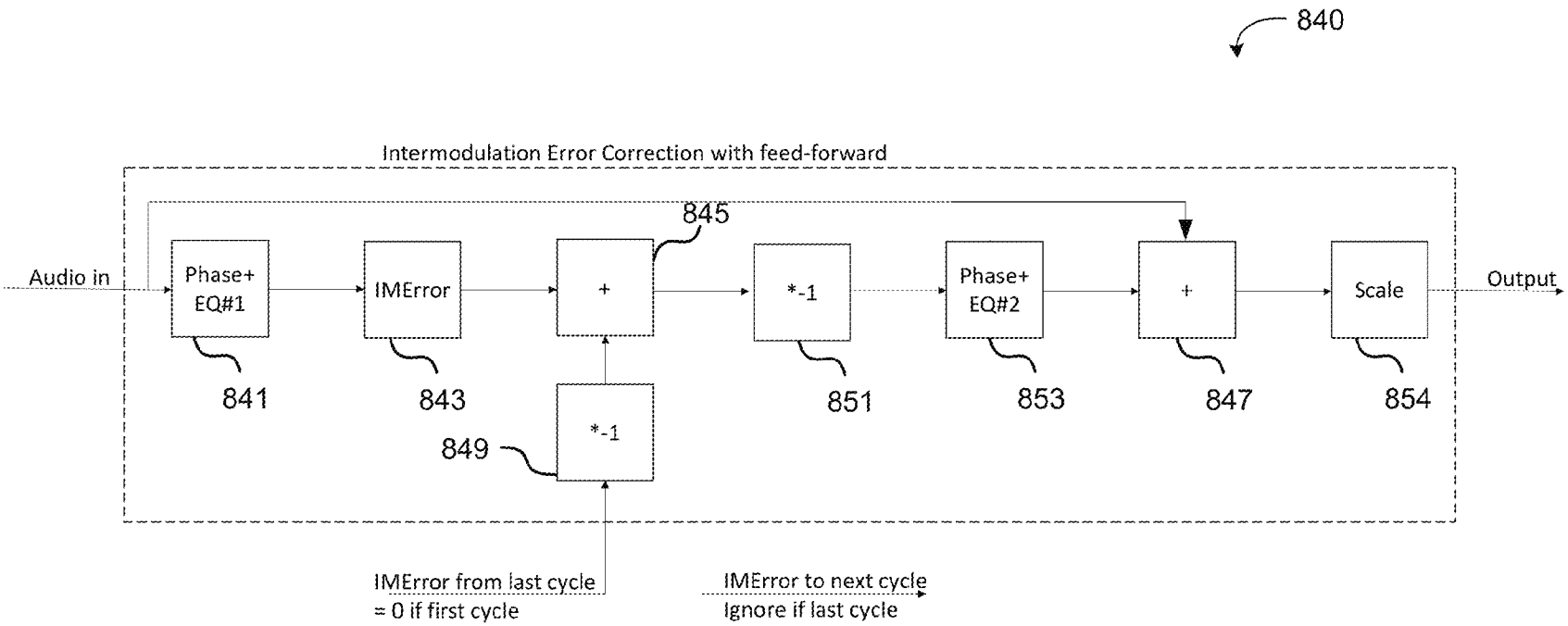
FIG. 17 is a diagram illustrating an example intermodulation error correction with feed-forward processing in accordance with one embodiment of the technology described herein.

FIG. 17 is a diagram illustrating an example intermodulation error correction with feed-forward processing in accordance with one embodiment of the technology described herein. As seen in FIG. 17, this example includes two Phase+EQ modules 841, 853, an IM error correction module 843, two summing modules 845, 847, two inversion modules 849, 851 and a scaling module 854. Inversion modules 849, 851 can be implemented to generate the additive inverse of their respective input signals (e.g., perform a *−1 operation). Phase+EQ modules 841, 853, IM error correction module 843, summing module 847, inversion module 851 and scaling module 854 can be implemented using the same features and functionality as described above for the corresponding blocks in FIG. 14.

In this example with feedforward, the intermodulation error from a previous cycle, if any, is fed into inverter module 849 and the inverse thereof is combined with (e.g., the additive inverse is summed with) the output of IM error correction module 843 by summing module 845. If the current cycle is the first cycle in the recursion, a 0 (i.e, nothing) is added to the output of IM error correction module 843. The pre-distorted output from summing module 845 is made available for the next cycle in the recursion, unless the current cycle is the last cycle.

Figure 18:
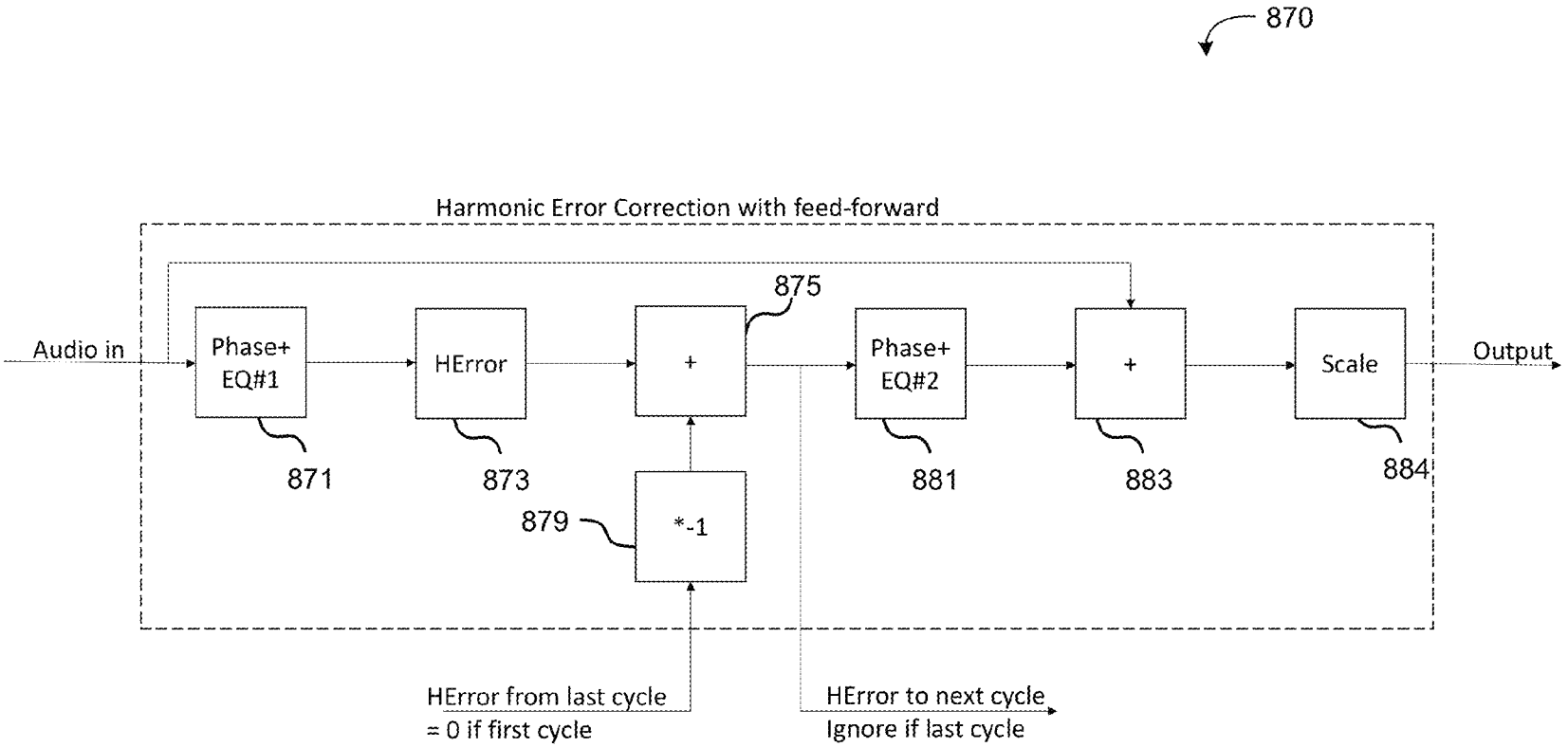
FIG. 18 is a diagram illustrating an example of harmonic distortion error correction with feed-forward processing in accordance with one embodiment of the technology disclosed herein.
Figure 19:
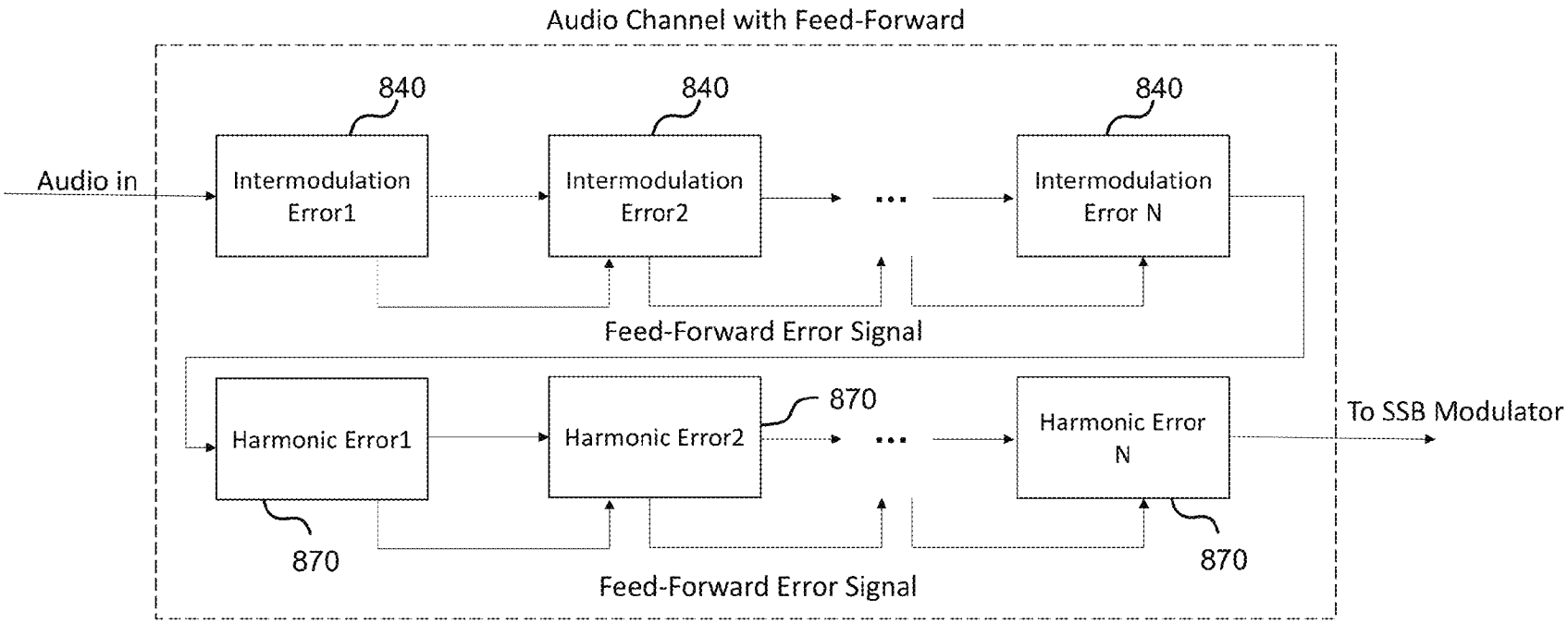
FIG. 19 is a diagram illustrating an example of the-forward, recursive processing in accordance with another embodiment of the systems and methods disclosed herein.

FIG. 18 is a diagram illustrating an example of a harmonic distortion error correction module 870 with feed-forward processing in accordance with one embodiment of the technology disclosed herein. Particularly, this example illustrates that in embodiments using multiple rounds of harmonic distortion error correction, information from previous calculations can be used in a current calculation to improve the error correction. This example is similar to that as shown above in FIG. 17, however this shows harmonic distortion error correction instead of intermodulation error correction. This example includes two Phase+EQ modules 871, 881, a harmonic distortion error estimation module 873, two summing modules 875, 877 a phase inverter module 879 and a scaling module 884. Although two Phase+EQ modules 871, 881, the harmonic distortion error correction module 870 can be implemented with one Phase+EQ module. For example, either Phase+EQ module 871 or 881 can be omitted or configured to not make any adjustments to the signal. Phase+EQ modules 871, 881, HError estimation module 873, summing module 883 and scaling module 884 can be implemented using the same features and functionality as described above for the corresponding modules in FIG. 15.

In the case of harmonic distortion error correction as in FIG. 18, the harmonic distortion error signal from the previous cycle, if any, is fed into phase inverter module 879. The inverse of that error signal from the previous cycle (e.g., the additive inverse) is summed with the output of harmonic distortion error estimation module 873 by summing module 875. If the current cycle is the first cycle in the recursion, there is nothing to be summed at this step. The pre-distorted output from summing module 875 is made available for the next cycle in the recursion unless the current cycle is the last cycle.

FIG. 19 is a diagram illustrating an example of feed-forward, recursive processing in accordance with another embodiment of the systems and methods disclosed herein. This example shows multiple rounds of feed-forward error correction for both intermodulation error correction and harmonic distortion error correction. This also illustrates an example in which the error signals from a given round (the feed-forward error signals) can be fed forward and used in the next round of correction.

As with various of the embodiments for recursive processing discussed above, the order of error correction can be reversed. Likewise, each round may have different values for Phase+EQ and Scaling, which may be all set sequentially via empirical measurement. Also, in this example, the corrections for the different types can be interleaved, but such interleaving should be done in pairs because the feed-forward error signal must be from the same type of error correction. Lastly, one can mix non-feed-forward processing and feed-forward processing between the different types of error correction. This means that for intermodulation correction, for example, one could use non-feed-forward processing and follow that with feed-forward processing for harmonic error correction, or vice versa. The choice for implementing such a hybrid approach may depend on, for example, the type of emitter used and the amount of processing power available for the process.

In the embodiments described above, receive circuits can be included to receive the various audio input signal (or processed audio input signals) in analog or digital form. The received audio input signal can be an analog signal representing audio content to be played over the ultrasonic audio system, or in subsequent stages of multi-stage embodiments, a pre-processed audio signal as processed by the prior stage(s). In digital implementations, using a DSP for example, the received audio input signal can be a digital signal or it can be converted (e.g., using an analog-to-digital converter, for example) for digital processing. Accordingly, receivers can include, for example, an input line, circuitry (e.g., forming an op amp or other signal receiver), or any of a number of conventionally available or conventionally used audio input receivers. For DSP or other like digital applications, the received audio input can be digitized for digital processing prior to or after being received at the correction module.

One or more of the processing operations described with reference to FIG. 2, such as equalization, compression, and filtering, can be done before the original audio input signal is received by the correction modules, or they can be applied after one or more stages of correction have been applied. Although in various embodiments described above, the error correction is described as being applied to the audio signals before modulation onto an ultrasonic carrier, embodiments of the systems and methods described herein can be implemented in which the error correction is performed either before or after modulation of the audio signal onto the ultrasonic carrier.

As used herein, the term module might describe a given unit of functionality that can be performed in accordance with one or more embodiments of the technology disclosed herein. As used herein, modules, including IMError modules, HError modules, summing modules, phase inverters, scaling modules and so on can be implemented utilizing any form of hardware, software, or a combination thereof. For example, one or more processors, controllers, ASICs, PLAs, PALs, CPLDs, FPGAs, logical components, software routines or other mechanisms might be implemented to make up a module. For example, for digital embodiments, various embodiments can be implemented using one or more DSPs and associated components (e.g., memory, I/Os ADCs, DACs, and so on). Various components used in the error correction such as summing modules (e.g., combiners) and phase inverters, scalers, and phase and equalization modules are well known to those in the art and may be implemented using conventional technologies.

Figure 20:
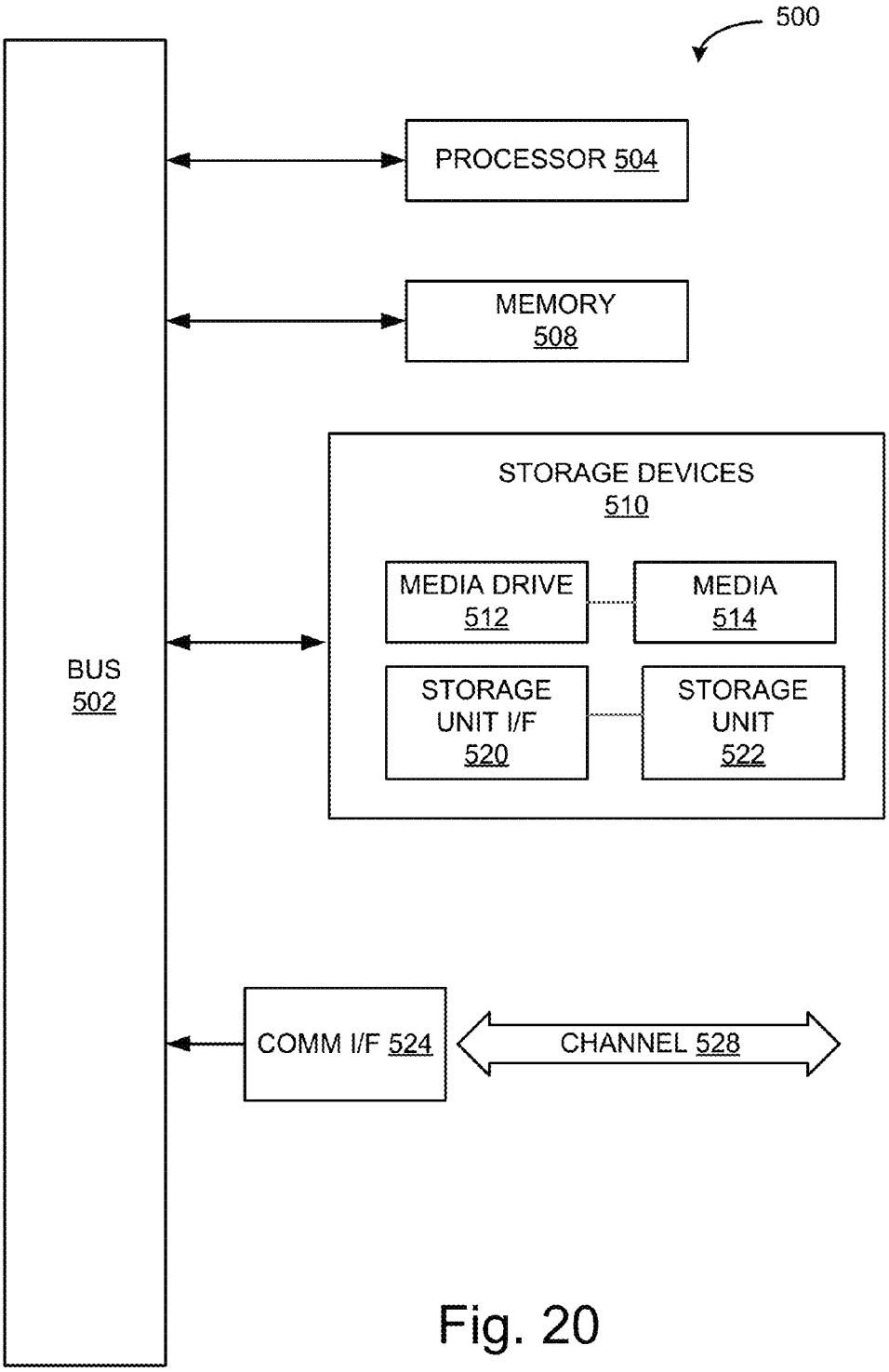
FIG. 20 illustrates an example computing module that may be used in implementing various features of embodiments of the disclosed technology.

In implementation, the various modules described herein might be implemented as discrete modules or the functions and features described can be shared in part or in total among one or more modules. In other words, as would be apparent to one of ordinary skill in the art after reading this description, the various features and functionality described herein may be implemented in any given application and can be implemented in one or more separate or shared modules in various combinations and permutations. Even though various features or elements of functionality may be individually described or claimed as separate modules, one of ordinary skill in the art will understand that these features and functionality can be shared among one or more common software and hardware elements, and such description shall not require or imply that separate hardware or software components are used to implement such features or functionality. Unless otherwise specified, communicative coupling of a module to other modules or to other components can refer to a direct or indirect coupling. In other words, a module may be communicatively coupled to another component even though there may be intermediate components through which signals or data pass between the module and the other component.

Where components or modules of the technology are implemented in whole or in part using software, in one embodiment, these software elements can be implemented to operate with a computing or processing module capable of carrying out the functionality described with respect thereto. One such example computing module is shown in FIG. 20. Various embodiments are described in terms of this example-computing module 900. After reading this description, it will become apparent to a person skilled in the relevant art how to implement the technology using other computing modules or architectures.

Referring now to FIG. 20, computing module 900 may represent, for example, computing or processing capabilities found within desktop, laptop and notebook computers; hand-held computing devices (PDA's, smart phones, cell phones, palmtops, etc.); mainframes, supercomputers, workstations or servers; or any other type of special-purpose or general-purpose computing devices as may be desirable or appropriate for a given application or environment. Computing module 900 might also represent computing capabilities embedded within or otherwise available to a given device. For example, a computing module might be found in other electronic devices such as, for example, digital cameras, navigation systems, cellular telephones, portable computing devices, modems, routers, WAPs, terminals and other electronic devices that might include some form of processing capability.

Computing module 900 might include, for example, one or more processors, controllers, control modules, or other processing devices, such as a processor 904. Processor 904 might be implemented using a general-purpose or special-purpose processing engine such as, for example, a microprocessor, controller, digital signal processor or other control logic. In the illustrated example, processor 904 is connected to a bus 902, although any communication medium can be used to facilitate interaction with other components of computing module 900 or to communicate externally.

Computing module 900 might also include one or more memory modules, simply referred to herein as main memory 908. For example, preferably random access memory (RAM) or other dynamic memory, might be used for storing information and instructions to be executed by processor 904. Main memory 908 might also be used for storing temporary variables or other intermediate information during execution of instructions to be executed by processor 904. Computing module 900 might likewise include a read only memory ("ROM") or other static storage device coupled to bus 902 for storing static information and instructions for processor 904.

The computing module 900 might also include one or more various forms of information storage mechanism 910, which might include, for example, a media drive 912 and a storage unit interface 920. The media drive 912 might include a drive or other mechanism to support fixed or removable storage media 914. For example, a hard disk drive, a floppy disk drive, a magnetic tape drive, an optical disk drive, a CD or DVD drive (R or RW), or other removable or fixed media drive might be provided. Accordingly, storage media 914 might include, for example, a hard disk, a floppy disk, magnetic tape, cartridge, optical disk, a CD or DVD, or other fixed or removable medium that is read by, written to or accessed by media drive 912. As these examples illustrate, the storage media 914 can include a computer usable storage medium having stored therein computer software or data.

In alternative embodiments, information storage mechanism 910 might include other similar instrumentalities for allowing computer programs or other instructions or data to be loaded into computing module 900. Such instrumentalities might include, for example, a fixed or removable storage unit 922 and an interface 920. Examples of such storage units 922 and interfaces 920 can include a program cartridge and cartridge interface, a removable memory (for example, a flash memory or other removable memory module) and memory slot, a PCMCIA slot and card, and other fixed or removable storage units 922 and interfaces 920 that allow software and data to be transferred from the storage unit 922 to computing module 900.

Computing module 900 might also include a communications interface 924. Communications interface 924 might be used to allow software and data to be transferred between computing module 900 and external devices. Examples of communications interface 924 might include a modem or softmodem, a network interface (such as an Ethernet, network interface card, WiMedia, IEEE 802.XX or other interface), a communications port (such as for example, a USB port, IR port, RS232 port Bluetooth® interface, or other port), or other communications interface. Software and data transferred via communications interface 924 might typically be carried on signals, which can be electronic, electromagnetic (which includes optical) or other signals capable of being exchanged by a given communications interface 924. These signals might be provided to communications interface 924 via a channel 928. This channel 928 might carry signals and might be implemented using a wired or wireless communication medium. Some examples of a channel might include a phone line, a cellular link, an RF link, an optical link, a network interface, a local or wide area network, and other wired or wireless communications channels.

In this document, the terms "computer program medium" and "computer usable medium" are used to generally refer to media such as, for example, memory 908, storage unit 922, media 914, and channel 928. These and other various forms of computer program media or computer usable media may be involved in carrying one or more sequences of one or more instructions to a processing device for execution. Such instructions embodied on the medium, are generally referred to as "computer program code" or a "computer program product" (which may be grouped in the form of computer programs or other groupings). When executed, such instructions might enable the computing module 900 to perform features or functions of the disclosed technology as discussed herein.

While various embodiments of the disclosed technology have been described above, it should be understood that they have been presented by way of example only, and not of limitation. Likewise, the various diagrams may depict an example architectural or other configuration for the disclosed technology, which is done to aid in understanding the features and functionality that can be included in the disclosed technology. The disclosed technology is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the technology disclosed herein. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the disclosed technology is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the disclosed technology, whether or not such embodiments are described and whether or not such features are presented as being a part of a described embodiment. Thus, the breadth and scope of the technology disclosed herein should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof;

the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed in multiple groupings or packages or across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. A method for reducing distortion in an ultrasonic audio system, comprising:

receiving a first audio signal, wherein the first audio signal represents audio content to be reproduced using the ultrasonic audio system;

calculating a first error function for the ultrasonic audio system, the first error function comprising $H(x_1)^2+x_1^2$, where $x_1$ is the received first audio signal and $H(x_1)$ is a Hilbert transform; and transforming the first audio signal into a first pre-conditioned audio signal by combining an additive inverse of the first error function with the first audio signal.

2. The method of claim 1, further comprising applying a phase shift or an amplitude adjustment, or both, as a function of frequency, to the first error function or the additive inverse of the first error function before the step of combining to adjust for emitter or filter responses.

3. The system of claim 2, wherein the error correction module is further configured to apply a phase shift or an amplitude adjustment, or both, as a function of frequency, to the first audio signal.

4. The method of claim 3, further comprising:

receiving the first pre-conditioned audio signal;

applying a phase shift or an amplitude adjustment, or both, as a function of frequency, to the first pre-conditioned audio signal to generate an adjusted pre-conditioned audio signal;

calculating a second error function for the ultrasonic audio system, wherein the second error function comprises $H(x_2)^2-x_2^2$, where $x_2$ is the adjusted pre-conditioned audio signal and $H(x_2)$ is a Hilbert transform of the adjusted pre-conditioned audio signal;

applying a phase shift or an amplitude adjustment, or both, as a function of frequency, to the second error function to produce a third error function; and transforming the first pre-conditioned audio signal into a second pre-conditioned audio signal by combining the third error function with the adjusted pre-conditioned audio signal.

5. The method of claim 2, further comprising an additional cycle of error correction, comprising:

receiving the first pre-conditioned audio signal and the first error function for the additional cycle of error correction;

calculating a second error function for the ultrasonic audio system, the second error function comprising $H(x_2)^2+x_2^2$, where $x_2$ is the first pre-conditioned audio signal and $H(x_2)$ is a Hilbert transform of the first pre-conditioned audio signal; and transforming the first pre-conditioned audio signal into a second pre-conditioned audio signal by combining the additive inverse of second error function with the received first audio signal.

6. The method of claim 5, further comprising adjusting for emitter or filter responses by applying a phase shift or an amplitude adjustment, or both, as a function of frequency, to the second error function or the additive inverse of the second error function before the step of combining the additive inverse of second error function.

7. The system of claim 6, wherein the error correction module is further configured to apply a phase shift or an amplitude adjustment, or both, as a function of frequency, to the first pre-conditioned audio signal.

8. The method of claim 2, further comprising an additional cycle of error correction, comprising:

receiving the first pre-conditioned audio signal and the first error function for the additional cycle of error correction prior to the modulation;

calculating a second error function for the ultrasonic audio system, the second error function comprising $H(x_2)^2+x_2^2$, where $x_2$ is the first pre-conditioned audio signal and $H(x_2)$ is a Hilbert transform of the first pre-conditioned audio signal;

combining the additive inverse of the first error function with the second error function to generate a third error function; and calculating the additive inverse of the third error function;

transforming the first pre-conditioned audio signal into a second pre-conditioned audio signal by combining the additive inverse of third error function with the first pre-conditioned audio signal.

9. The method of claim 8, further comprising applying a phase shift or an amplitude adjustment, or both, as a function of frequency, to the third error function or the additive inverse of the third error function before the step of combining to adjust for emitter or filter responses.

10. The system of claim 9, wherein the error correction module is further configured to apply a phase shift or an amplitude adjustment, or both, as a function of frequency, to the first pre-conditioned audio signal.

11. The method of claim 3, further comprising an additional cycle of error correction, comprising:

receiving the first pre-conditioned audio signal and the first error function for the additional cycle of error correction;

applying a phase shift or an amplitude adjustment, or both, as a function of frequency, to the pre-conditioned audio signal to generate an adjusted pre-conditioned audio signal;

calculating a second error function for the ultrasonic audio system, the second error function comprising $H(x_2)^2+x_2^2$, where $x_2$ is the adjusted pre-conditioned audio signal and $H(x_2)$ is a Hilbert transform of the adjusted pre-conditioned audio signal;

applying a phase shift or an amplitude adjustment, or both, as a function of frequency, to the second error function to produce a third error function; and transforming the first pre-conditioned audio signal into a second pre-conditioned audio signal by combining the additive inverse of third error function with the received first audio signal.

12. The method of claim 3, further comprising an additional cycle of error correction, comprising:

receiving the first pre-conditioned audio signal and the first error function for the additional cycle of error correction;

applying a phase shift or an amplitude adjustment, or both, as a function of frequency, to the pre-conditioned audio signal to generate an adjusted pre-conditioned audio signal;

calculating a second error function for the ultrasonic audio system, the second error function comprising $H(x_2)^2+x_2^2$, where $x_2$ is the adjusted pre-conditioned audio signal and $H(x_2)$ is a Hilbert transform of the adjusted pre-conditioned audio signal;

combining the additive inverse of the first error function with the second error function to generate a third error function;

applying a phase shift or an amplitude adjustment, or both, as a function of frequency, to the third error function to produce a fourth error function; and calculating the additive inverse of the fourth error function;

transforming the first pre-conditioned audio signal into a second pre-conditioned audio signal by combining the additive inverse of the fourth error function with the first pre-conditioned audio signal.

13. The method of claim 11, further comprising:

receiving the second pre-conditioned audio signal;

applying a phase shift or an amplitude adjustment, or both, as a function of frequency, to the second pre-conditioned audio signal to generate an adjusted second pre-conditioned audio signal;

calculating a fourth error function for the ultrasonic audio system, wherein the fourth error function comprises $H(x_3)^2-x_3^2$, where $x_3$ is the adjusted second pre-conditioned audio signal and $H(x_3)$ is a Hilbert transform of the adjusted second pre-conditioned audio signal;

applying a phase shift or an amplitude adjustment, or both, as a function of frequency, to the fourth error function to produce a fifth error function; and transforming the second pre-conditioned audio signal into a third pre-conditioned audio signal by combining the fifth error function with the second pre-conditioned audio signal.

14. The method of claim 12, further comprising:

receiving the second pre-conditioned audio signal;

applying a phase shift or an amplitude adjustment, or both, as a function of frequency, to the second pre-conditioned audio signal to generate an adjusted second pre-conditioned audio signal;

calculating a fifth error function for the ultrasonic audio system, wherein the fifth error function comprises $H(x_3)^2-x_3^2$, where $x_3$ is the adjusted second pre-conditioned audio signal and $H(x_3)$ is a Hilbert transform of the adjusted second pre-conditioned audio signal;

applying a phase shift or an amplitude adjustment, or both, as a function of frequency, to the fifth error function to produce a sixth error function; and transforming the second pre-conditioned audio signal into a third pre-conditioned audio signal by combining the sixth error function with the second pre-conditioned audio signal.

15. The method of claim 13, further comprising an additional cycle of error correction, comprising:

receiving the third pre-conditioned audio signal and the fourth error function for the additional cycle of error correction;

applying a phase shift or an amplitude adjustment, or both, as a function of frequency, to the third pre-conditioned audio signal to generate an adjusted third pre-conditioned audio signal;

calculating a sixth error function for the ultrasonic audio system, the sixth error function comprising $H(x_4)^2-x_4^2$, where $x_4$ is the adjusted third pre-conditioned audio signal and $H(x_4)$ is a Hilbert transform of the adjusted third pre-conditioned audio signal;

combining the additive inverse of the fourth error function with the sixth error function to generate a seventh error function;

applying a phase shift or an amplitude adjustment, or both, as a function of frequency, to the seventh error function to produce an eighth error function; and transforming the third pre-conditioned audio signal into a fourth pre-conditioned audio signal by combining the eighth error function with the third pre-conditioned audio signal.

16. The method of claim 13, further comprising an additional cycle of error correction, comprising:

receiving the third pre-conditioned audio signal and the second pre-conditioned audio signal;

applying a phase shift or an amplitude adjustment, or both, as a function of frequency, to the third pre-conditioned audio signal to generate an adjusted third pre-conditioned audio signal;

calculating a sixth error function for the ultrasonic audio system, the sixth error function comprising $H(x_4)^2-x_4^2$, where $x_4$ is the adjusted third pre-conditioned audio signal and $H(x_4)$ is a Hilbert transform of the adjusted third pre-conditioned audio signal;

applying a phase shift or an amplitude adjustment, or both, as a function of frequency, to the sixth error function to produce an seventh error function; and transforming the third pre-conditioned audio signal into a fourth pre-conditioned audio signal by combining the seventh error function with the second pre-conditioned audio signal.

17. The method of claim 14, further comprising an additional cycle of error correction, comprising:

receiving the third pre-conditioned audio signal and the fifth error function for the additional cycle of error correction to generate an adjusted third pre-conditioned audio signal;

applying a phase shift or an amplitude adjustment, or both, as a function of frequency, to the third pre-conditioned audio signal;

calculating a seventh error function for the ultrasonic audio system, the seventh error function comprises $H(x_4)^2-x_4^2$, where $x_4$ is the adjusted third pre-conditioned audio signal and $H(x_4)$ is a Hilbert transform of the adjusted third pre-conditioned audio signal;

combining the additive inverse of the fifth error function with the seventh error function to generate an eighth error function;

applying a phase shift or an amplitude adjustment, or both, as a function of frequency, to the eighth error function to produce a ninth error function; and transforming the third pre-conditioned audio signal into a fourth pre-conditioned audio signal by combining the ninth error function with the third pre-conditioned audio signal.

18. The method of claim 14, further comprising an additional cycle of error correction, comprising:

receiving the third pre-conditioned audio signal and the second pre-conditioned audio signal;

applying a phase shift or an amplitude adjustment, or both, as a function of frequency, to the third pre-conditioned audio signal to generate an adjusted third pre-conditioned audio signal;

calculating a seventh error function for the ultrasonic audio system, the seventh error function comprises $H(x_4)^2-x_4^2$, where $x_4$ is the adjusted third pre-conditioned audio signal and $H(x_4)$ is a Hilbert transform of the adjusted third pre-conditioned audio signal;

applying a phase shift or an amplitude adjustment, or both, as a function of frequency, to the seventh error function to produce an eighth error function; and transforming the third pre-conditioned audio signal into a fourth pre-conditioned audio signal by combining the eighth error function with the received second pre-conditioned audio signal.

19. The method of claim 1, further comprising:

receiving the first pre-conditioned audio signal;

calculating a second error function for the ultrasonic audio system, wherein the second error function comprises $H(x_2)^2-x_2^2$, where $x_2$ is the received pre-conditioned audio signal and $H(x_2)$ is a Hilbert transform of the pre-conditioned audio signal; and transforming the first pre-conditioned audio signal into a second pre-conditioned audio signal by combining the second error function with the first pre-conditioned audio signal.

20. A method for reducing distortion in an ultrasonic audio system, comprising:

receiving a first audio signal, wherein the first audio signal represents audio content to be reproduced using the ultrasonic audio system;

calculating a first error function for the ultrasonic audio system, the first error function comprising $H(x_1)^2-x_1^2$, where $x_1$ is the received first audio signal and $H(x_1)$ is a Hilbert transform; and transforming the first audio signal into a first pre-conditioned audio signal by combining the first error function with the first audio signal.

21. The method of claim 20, further comprising applying a phase shift or an amplitude adjustment, or both, as a function of frequency, to the first error function before the step of combining to adjust for emitter or filter responses.

22. The system of claim 21, wherein the error correction module is further configured to apply a phase shift or an amplitude adjustment, or both, as a function of frequency, to the first audio signal.

23. The method of claim 21, further comprising an additional cycle of error correction, comprising:

receiving the first pre-conditioned audio signal and the first error function for the additional cycle of error correction;

calculating a second error function for the ultrasonic audio system, the second error function comprising $H(x_2)^2-x_2^2$, where $x_2$ is the first pre-conditioned audio signal and $H(x_2)$ is a Hilbert transform of the first pre-conditioned audio signal; and transforming the first pre-conditioned audio signal into a second pre-conditioned audio signal by combining the second error function with the received first audio signal.

24. The method of claim 23, further comprising applying a phase shift or an amplitude adjustment, or both, as a function of frequency, to the second error function before the step of combining to adjust for emitter or filter responses.

25. The system of claim 24, wherein the error correction module is further configured to apply a phase shift or an amplitude adjustment, or both, as a function of frequency, to the first pre-conditioned audio signal.

26. The method of claim 21, further comprising an additional cycle of error correction, comprising:

receiving the first pre-conditioned audio signal and the first error function for the additional cycle of error correction prior to the modulation;

calculating a second error function for the ultrasonic audio system, the second error function comprising $H(x_2)^2-x_2^2$, where $x_2$ is the first pre-conditioned audio signal and $H(x_2)$ is a Hilbert transform of the first pre-conditioned audio signal;

combining the additive inverse of the first error function with the second error function to generate a third error function; and transforming the first pre-conditioned audio signal into a second pre-conditioned audio signal by combining the additive inverse of third error function with the first pre-conditioned audio signal.

27. The method of claim 26, further comprising applying a phase shift or an amplitude adjustment, or both, as a function of frequency, to the third error function before the step of combining to adjust for emitter or filter responses.

28. The system of claim 27, wherein the error correction module is further configured to apply a phase shift or an amplitude adjustment, or both, as a function of frequency, to the first pre-conditioned audio signal.

29. A system for reducing distortion in an ultrasonic audio system, comprising:

a receiver that receives a first audio signal, wherein the received first audio signal represents audio content to be reproduced using the ultrasonic audio system; and a non-transitory computer-readable medium operatively coupled to a processor, and having instructions stored thereon that, when executed by the processor:

calculates a first error function for the ultrasonic audio system, the first error function comprising $H(x_1)^2+x_1^2$, where $x_1$ is the received first audio signal and $H(x_1)$ is a Hilbert transform of the received first audio signal; and transforms the received first audio signal into a first pre-conditioned audio signal by combining an additive inverse of the first error function with the received first audio signal.

* * * * *